US005577356A

United States Patent [19]

Hubbard et al.

[11] Patent Number: 5,577,356

[45] Date of Patent: Nov. 26, 1996

[54] PRE-CUT BUILDING METHOD AND STRUCTURE

[75] Inventors: John L. Hubbard, Mercer Island; Russell T. Barney, Redmond, both of Wash.

[73] Assignee: Panabode Cedar Homes, Inc., Renton, Wash.

[21] Appl. No.: 218,123

[22] Filed: Mar. 25, 1994

[51] Int. Cl.[6] ..... E04B 1/10

[52] U.S. Cl. ..... 52/233; 52/295

[58] Field of Search ..... 52/233, 293.1, 52/295

[56] References Cited

U.S. PATENT DOCUMENTS

| | | | |
|---|---|---|---|
| 2,368,523 | 1/1945 | Cowbourne | 52/293.1 |
| 3,422,585 | 1/1969 | Dismukes | 52/295 |
| 3,462,897 | 8/1969 | Weinrott | 52/295 |
| 4,570,403 | 2/1986 | Dannemiller | 52/295 |
| 4,739,598 | 4/1988 | Jensen et al. | 52/295 |
| 4,869,036 | 9/1989 | Peacock | 52/233 |
| 5,207,042 | 5/1993 | Molinar | 52/293.1 |
| 5,265,390 | 11/1993 | Tanner | 52/233 |

FOREIGN PATENT DOCUMENTS 2456177 1/1981 France .

*Primary Examiner*—Carl D. Friedman
*Assistant Examiner*—Yvonne Horton-Richardson
*Attorney, Agent, or Firm*—Robert B. Hughes; Hughes, Multer & Schacht

[57] ABSTRACT

A pre-cut building structure and method of erecting the same, wherein there is a plurality of vertical columns, each having vertically aligned grooves to receive end portions of related timbers. The columns are located, and the wall sections are formed by stacking the timbers in aligned slots of pairs of columns. The timbers are bonded to one another and to the columns to form the building structure, and loads on the building structure that would tend to deform the wall structure in a plane parallel to the length of the timbers are resisted by the bonded connections between the timbers.

20 Claims, 26 Drawing Sheets

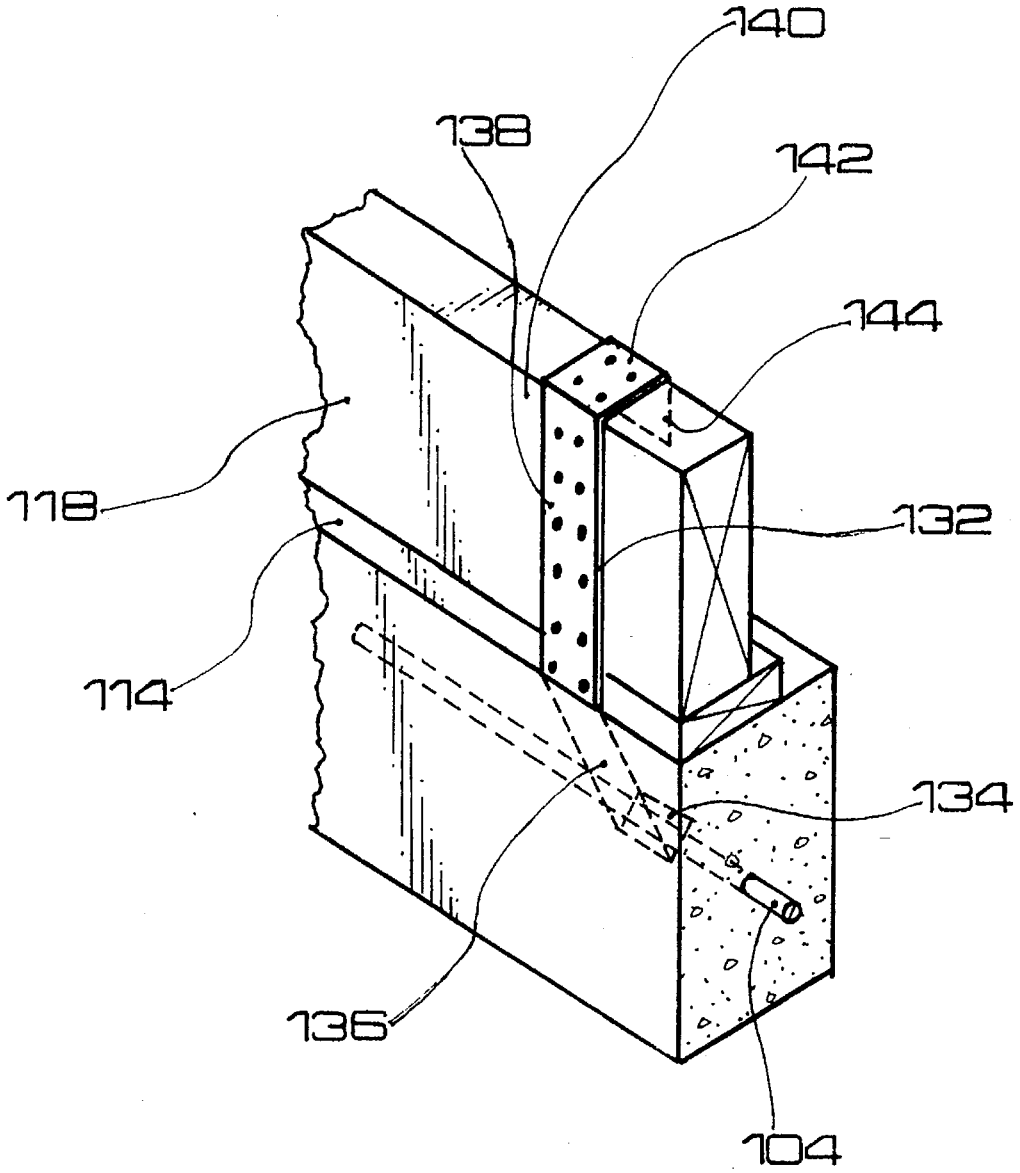
FIG-13-A

PRE-CUT BUILDING METHOD AND STRUCTURE

BACKGROUND OF THE INVENTION a. Field of the Invention

The present invention relates to a method of providing and erecting a pre-cut home or other building structure, and also to the structure itself, and more particularly to such a pre-cut home utilizing wood components that comprise wood columns and timbers which are pre-made and assembled at the building site to form the structure.

b. Background Art

For the last several decades, there has been an increasing popularity of what are commonly termed as pre-cut homes. One example of this is homes that are made of pre-cut logs. At a manufacturing location remote from the building site where the home or other structure is to be erected, the bottom and also sometimes the top surface of the log is usually cut or shaped in some manner so that it can be properly positioned against the adjacent log above and below, and the ends of the logs notched in a desired manner so that the ends of the logs lock into one another. With the log building being completed at the manufacturing site, each of the logs are marked, and the building is disassembled. Then these logs are shipped to the actual building location where these are reassembled to form the permanent building structure.

Another type of pre-made or pre-cut home which has become increasingly popular utilizes timbers which in cross-section are substantially rectangular. The traditional method of assembling these timbers into a home is to notch the ends of these timbers so that the timbers forming adjacent walls interlock with one another in somewhat the same manner as some log homes. The exterior of these homes have an attractive natural wood surface. The interior surface of these timbers can also be left exposed to provide a natural wood interior wall surface. Alternatively, portions of the interior wall surface can be covered with other structural materials (wallboard or other panels) for reasons of esthetics, providing additional insulation, etc.

One of the appealing features of these pre-cut timber homes is that the home owner himself (or herself) can do much or all of the work in actually assembling the wood structure, thus giving the home owner the satisfaction of building his, her or their own home.

SUMMARY OF THE INVENTION

While such homes utilizing precut timbers have been increasing in popularity, there is a continuing need to improve the overall designs of such homes, the designs of the components which are assembled to make the home, and also improvements in the methods of assembling the components to form the completed home.

Accordingly, it is an object of the present invention to provide improvements relative to these features, so as to provide a desirable balance of advantages with regard to such things as economy and efficiency of manufacture, convenience, use of materials, and efficiency in erecting the structure, and also providing advantages in the design of the end structure.

The method of the present invention is to provide pre-made building components and assemble these components at a building site to erect the wood timber structure. The method comprises first providing a building design that comprises a floor plan designating column locations and wall locations. Further, there is provided at the building site a plurality of wood columns, each having in cross section at least one vertical slot of a predetermined width and depth extending along the length of that column, and some of said columns having at least two of said slots.

There is also provided at the site a plurality of wood wall timbers, each of which has a lengthwise axis, and side, upper, lower and end surfaces. Each timber has at least one end portion with a width dimension matching the width of a related slot of a selected column so as to be able to fit within said related slot, with at least some of the timbers having two of said end portions.

A base structure is constructed, and the next step is to locate on the base structure the column locations. Then each of the columns is positioned vertically at the related column locations, and the columns are secured to the base structure. At least some of the columns (and in many instances most of the columns) comprise a pair of columns defining end location portions of a related wall location, with the columns of the pair having aligned slots facing each other at the end locations.

A group of timbers designated for the related wall location are selected, and these are positioned each in the aligned slots and placed one on top of the other in the aligned slots to form a wall section of timbers of the group. Then the timbers are secured to the columns of the pair and to one another at lengthwise locations along the length of each timber in a manner that relative movement of adjacent timbers in a direction parallel to the length of the timbers is resisted. Thus, lateral forces on the structure that would tend to distort the wall sections along a line parallel o a plane of the wall and parallel to the lengthwise dimension are effectively resisted by connecting means between the timbers.

Also, the present invention comprises a wood timber and column structure made in accordance with the method described above.

More particularly, in the preferred form, the timbers have a substantially uniform width dimension along the entire length which is the same as the width dimension of the end portions of the timbers. Thus, the entire timber can be pre-cut from a timber of uniform cross section.

Also, in the preferred form an adhesive composition is applied between adjacent surfaces of adjacent timbers of each wall section. Also, an adhesive composition is applied between adjacent surfaces of the end portions of the timbers and surfaces defining the slots of the column. Further, end portions of the timbers are mechanically interconnected to the columns in which the end portions are positioned.

Also, in the preferred form, a perimeter foundation wall is provided, and rim joist means is connected to the foundation wall along the length thereof. The columns are fixedly connected to the rim joist means. Desirably, the rim joist means is connected to the perimeter foundation wall by metal strap means engaging both the foundation wall and the rim joist means. Thus, loads tending to raise a portion of the structure vertically are resisted by the loads being transmitted from the structure into the columns, then into the rim joist means and into the perimeter foundation wall.

More particularly, there is a plurality of metal straps provided, and the lower ends of the metal straps are embedded in the foundation wall, which is a concrete foundation wall. The upper edges of the metal straps are secured to the rim joist means. Also, reinforcing bar means is provided in the concrete foundation wall, and the lower ends of the metal straps are attached to the reinforcing bar means.

At the upper portion of the structure, there is erected an upper diaphragm structure which is substantially rigid relative to elongation, contraction, and distortion in a horizontal plane. Thus, loads transmitted into the structure which would tend to distort wall sections of the structure relative to one another are resisted not only in the wall section, but also in the upper structure.

In an arrangement where there is an upper structure, there is provided at least some of the column members of a sufficient length to extend above an upper ceiling location of the structure. There is erected at least one additional wall section upwardly from said ceiling wall level by placing timbers in the slots of upper portions of the columns that extend above the upper ceiling location, and securing the timbers to one another into the upper portions of the columns.

Also, in some of these structures, there is provided a slanted roof structure. At least some upper surfaces of column members and timbers adjacent to the roof structure are formed with an upper surface means slanted from the horizontal to match the slant of the roof structure.

Also, in some embodiments, an interior wall section can be erected in the structure, this being done by connecting the interior wall construction to at least one of the columns.

The building structure made from the present invention comprises a base structure having column locations and wall locations. There is a plurality of column members, as described above, and these are fixedly attached and vertically positioned at the column locations. The wood timbers are positioned in the slots of related pairs of columns, stacked one on top of the other. As indicated previously, the timbers are connected by their end portions to the columns, in the preferred form both mechanically and by an adhesive composition. Further, the columns are in the preferred form adhesively bonded to one another along the length of the column, at surfaces of adjacent timbers.

Also, in the preferred form of the construction is that each of the timbers on which an additional timber is to be stacked has an upstanding elongate ridge at the top surface of that timber. Also, each timber that is to be stacked onto a lower timber has a matching elongate slot that receives the upstanding ridge of the lower timber. In the preferred form, an adhesive composition is applied over upper surface portions on opposite sides of each ridge member.

Other features of the present invention will become apparent from the following detailed description.

BRIEF DESCRIPTION OF THE DRAWINGS

FIGS. 8A through 8G are elevational views of wall sections of the home of FIGS. 7 and 8 where the timbers are pre-cut.

FIG. 13A an isometric view showing a rim joist securing strap of the present invention.

DESCRIPTION OF THE PREFERRED EMBODIMENTS

In the following text, there will first be a discussion of the prior art, followed by an explanation of the basic structure and methods of the present invention. Then in the following five sections, there will be a description of the basic structure and method of erection of the major portions of the structure, in accordance with the present invention. These will be grouped under appropriate headings.

A. Prior Art (FIGS. 1–5) Relating To Pre-cut Homes

Figure 1:
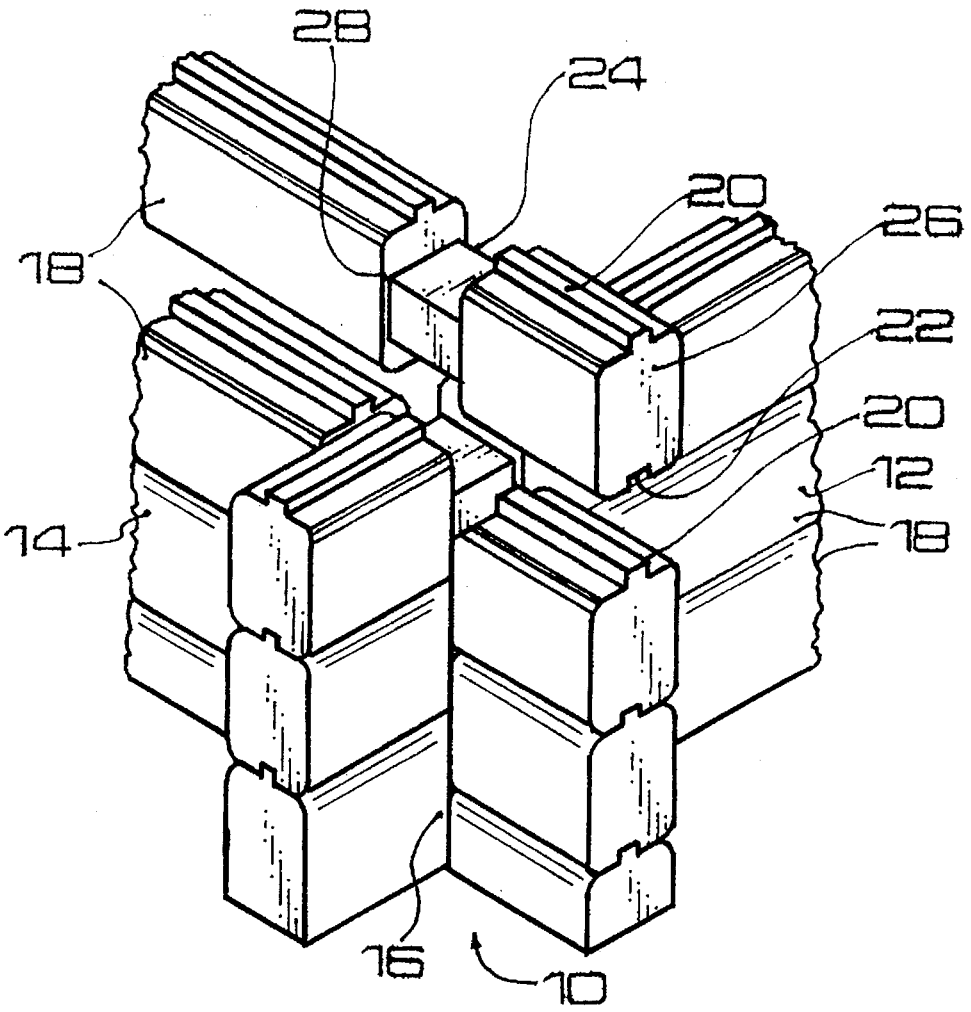
PRIOR ART FIG -1
FIG. 1 is an isometric view showing a typical corner where timbers of two wall sections of a prior art pre-cut home are being assembled.

FIG. 1 illustrates the basic construction which has been used for a number of decades in the design and erection of pre-cut timber homes. There is shown a corner section 10 of the prior art structure, this comprising two walls 12 and 14 which are joined at a corner 16. Each of the walls 12 and 14 is made of a plurality of timbers 18 which are stacked one on top of the other. It can be seen that the timbers 18 are formed with a top elongate ridge 20, and on the bottom side formed with a groove 22 which interfits with the ridge 20 on the immediately lower timber 18 in a tongue and groove fit.

To form the corner, each of the timbers 18 is notched, as indicated at 24, a short distance in from the end surface 26 of the timber 18. The notched portion 24 has a rectangular cross-sectional configuration, made up of upper and lower flat surfaces, and flat side surfaces. It will be noted that the side walls of the notched section 24 are cut inwardly a short distance from the adjacent timber surfaces, and the edges 28 of the timbers can be cut away slightly so that the timbers 18 can be interlocked with one another to make a snug fit.

The normal practice in the prior art is to pre-cut all of the timbers 18 to the appropriate length and cut out the notches, and mark each timber individually to indicate its exact location. At the building site where the final structure is to be erected, the timbers 18 for the adjacent walls 12 and 14 are put in place in an alternating sequence. Normally, the notched portions 24 are cut within a very close fit tolerance so that when a timber 18 is placed on the wall being erected, it is necessary to pound the timber downwardly to push it into place.

It could readily be seen from the above description that the pre-cut timber homes of the prior art, as shown in FIG. 1, are designed and erected in a manner rather similar to that in which log homes are constructed.

Figure 2:
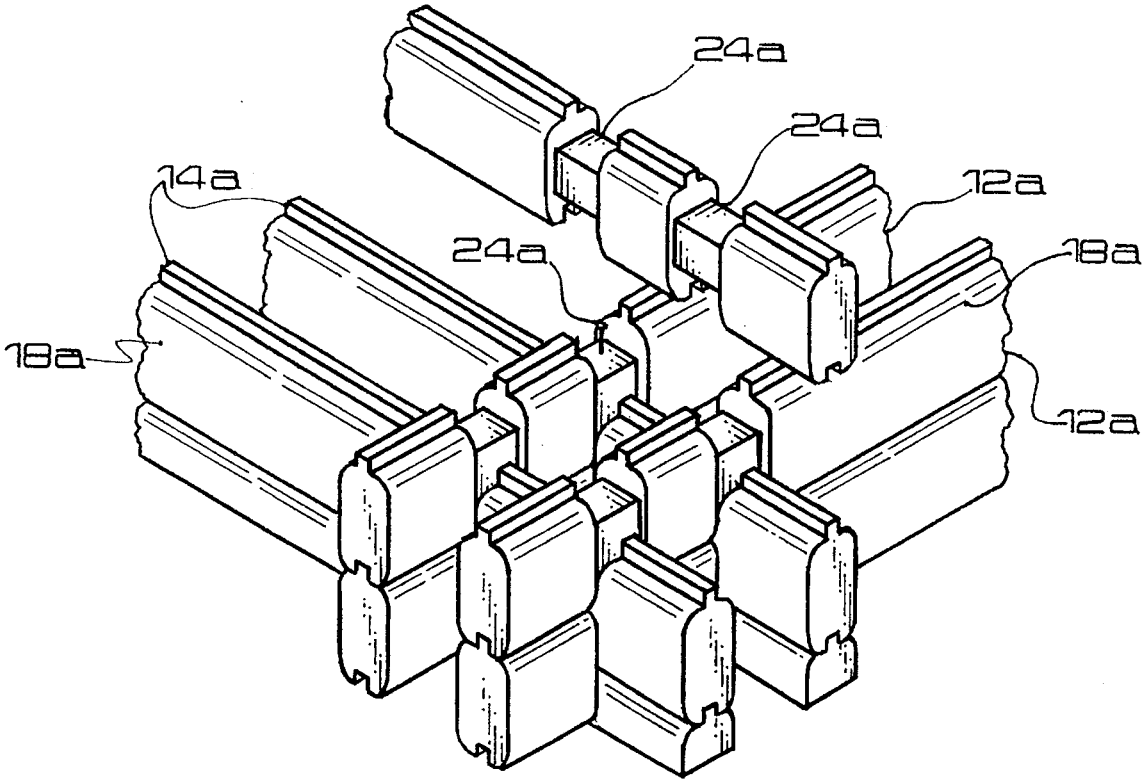
PRIOR ART FIG - 2
FIG. 2 is a view similar to FIG. 1, showing yet another prior art corner section of two walls, but having double wall sections.

FIG. 2 shows another prior art design for pre-cut timber homes. Components of this structure of FIG. 2 will be given numerical designations similar to those in FIG. 1 with an "a" suffix distinguishing the components of FIG. 2.

It can be seen that the same basic construction is used as in FIG. 1, except that there are inner and outer pairs of walls at 12*a*—12*a* and 14*a*—14*a*. Each timber 18*a* is made with two longitudinally spaced notched sections 24*a*, and these are interlocked in generally the same manner as shown in FIG. 1.

Figure 3:
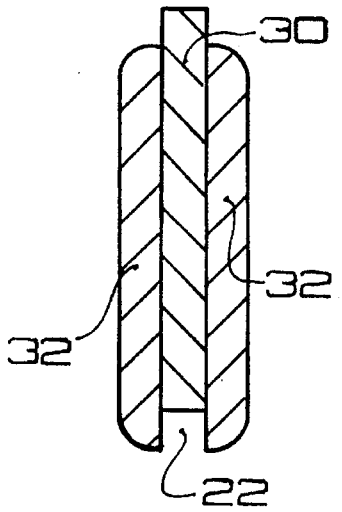
FIG-3 PRIOR ART
FIG. 3 is a cross-sectional view of a prior art timber utilized in wall construction of pre-cut timber homes shown in FIGS. 1 and 2.
Figure 4:
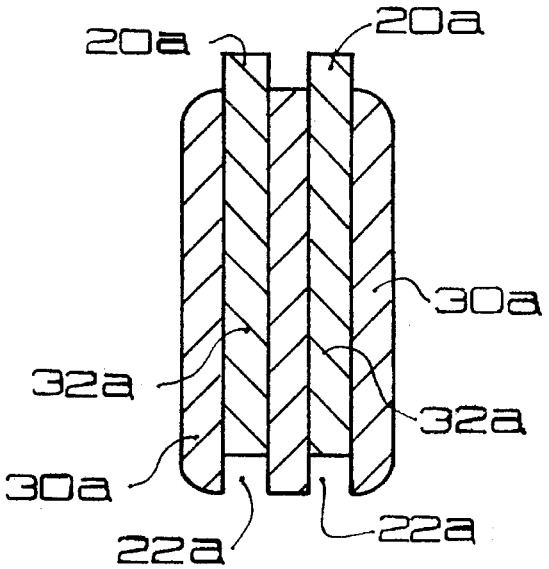
FIG-4 PRIOR ART
FIG. 4 is a cross-sectional view similar to FIG. 3 showing a different prior art timber configuration.
Figure 5:
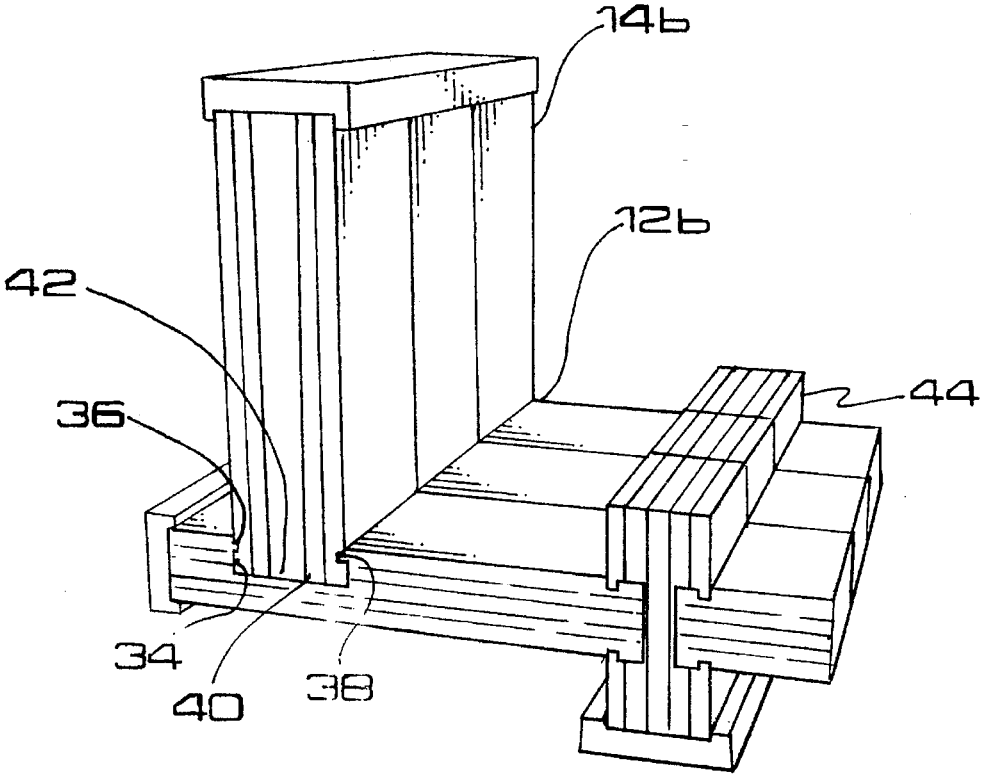
PRIOR ART FIG-5
FIG. 5 is a perspective view, looking downwardly, illustrating another prior art method of interconnecting wall sections and components of a pre-cut timber home.

FIG. 3 shows the cross-section of a typical prior art timber 18 which exists in the prior art, and which is used in the present invention. This timber 18 has a laminated structure, made up of a center portion 30 and two outer portions 32, bonded together by an adhesive. The two outer portions 32 can be offset from the center portion 30 so as to form an upper ridge 20 and the lower groove 22. Another prior art laminated timber is illustrated in FIG. 4, and it can be seen that this is made up of five laminations, designated 30*a* and 32*a*. It can be seen that the second and fourth laminations or portions 32*a* form two spaced upper ridges 20*a*, and also the two spaced lower grooves 22*a*. FIG. 5 shows another prior art arrangement of joining wall sections to one another. There are shown two walls 12*b* and 14*b*. One surface of the wall 12*b* is made with a cutout 34 formed with laterally and inwardly projecting ridge portions 36. The other wall 14*b* is formed with laterally positioned slots 38 which interfit with the ridge portions 36. This effectively forms each of the timbers 18*b* of the wall 14*b* with enlarged end portions 40 which fit within the slot 42 defined by the two ridges 36 in something of a T joint.

In that same figure, there is shown yet another wall connection where another wall 44 has an end portion which is notched out as at 46 to interfit with cutout portions 48 of the timbers that make up the wall of 12*b*.

B. Introductory Overview of the Method And Structure Of The Present Invention (FIGS. 6–10)

Figure 6:
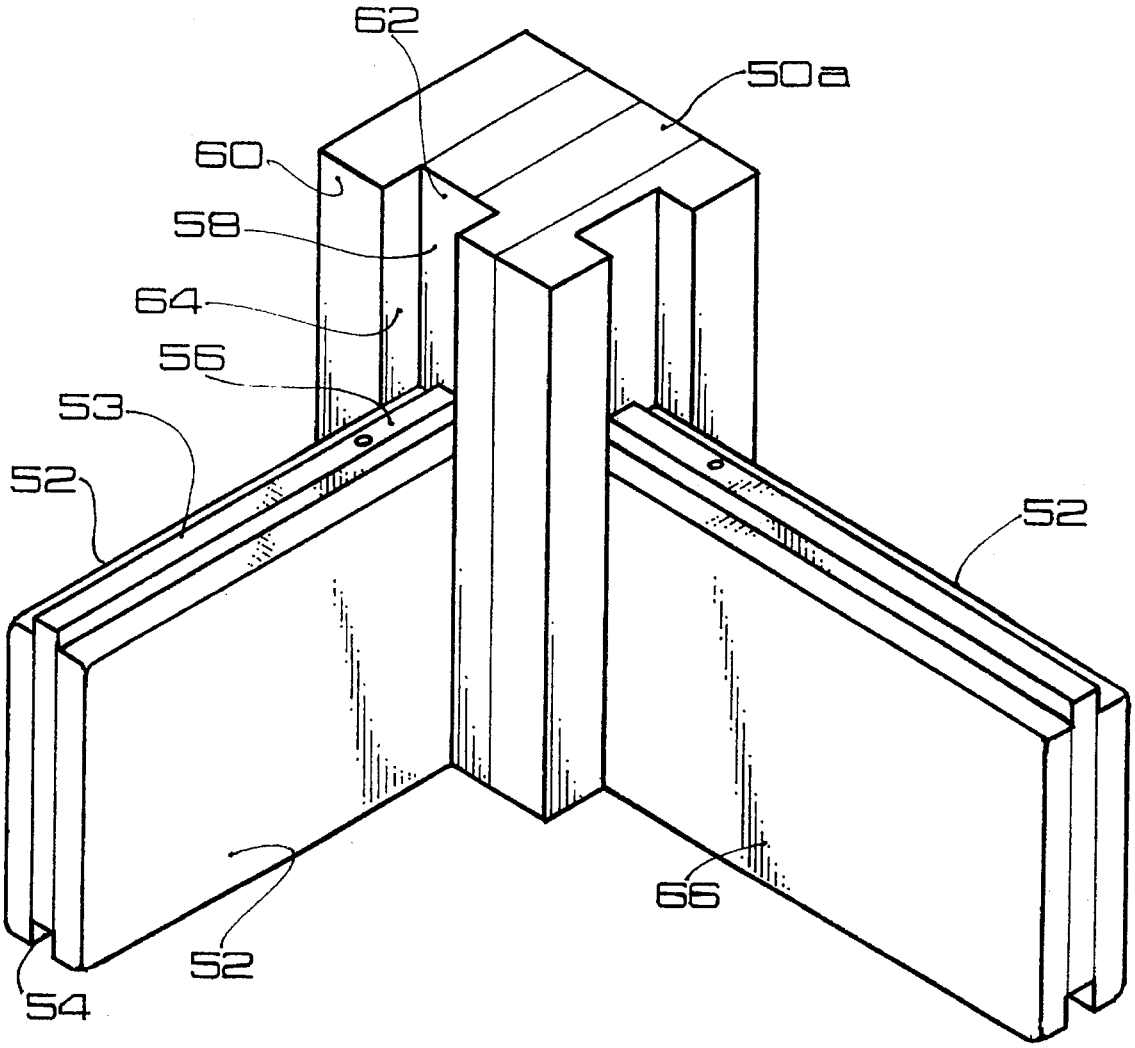
FIG. 6 is an isometric view illustrating a portion of a corner structure to illustrate the basic design of the present invention.

FIG. 6 is an isometric view which represents the basic system which is a significant part of the present invention. There is shown a post 50 (which is a corner post and will be designated specifically 50*a*) and two timbers 52, each having an upper elongate ridge 53 and a lower matching slot 54, and each having end portions 56 thereof fitting in vertical slots 58 formed at the post vertical surfaces 60 that face the related timbers 52. Each cutout 58 has a rectangular configuration and is formed with a back surface 62 and two side surfaces 64 positioned at right angles to the back surface 62 and to the related surface 60. It can be seen that the end portion 56 of the timber 52 does not need to be notched or especially configured in a particular manner, and the side surfaces 66 of the timber are able to fit with a reasonably close tolerant fit between the slot side surfaces 64.

Figure 7:
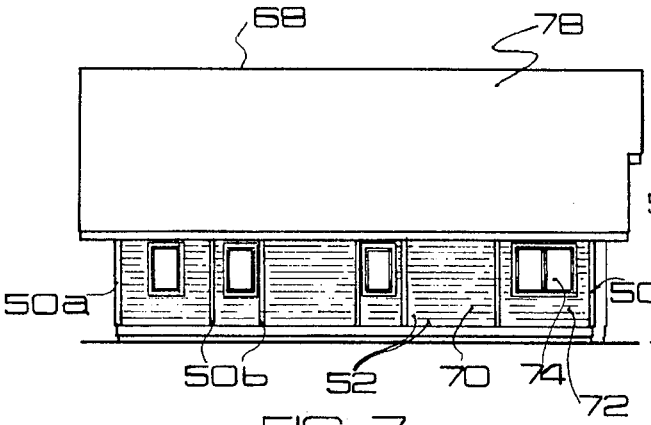
FIG. 7 is a side elevational view of one design of home made in accordance with the present invention.
Figure 8:
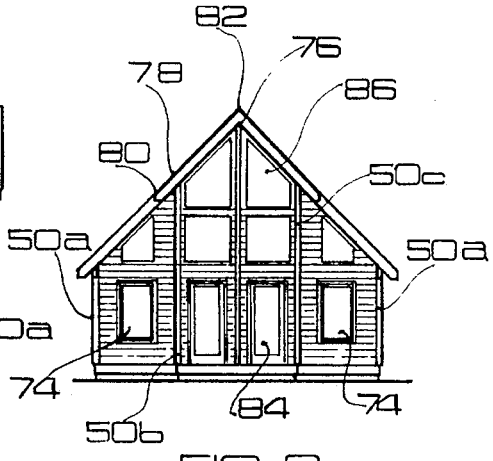
FIG. 8 is a front elevational view of the home shown in FIG. 7.
Figure 8A:
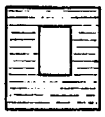
Figure 8B:
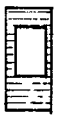
Figure 8C:
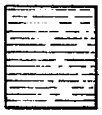
Figure 8D:
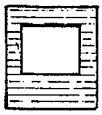
Figure 8E:
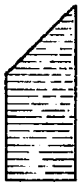
Figure 8G:
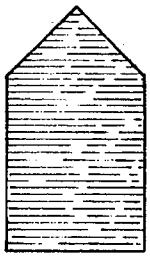

FIGS. 7 and 8 show a home which is constructed utilizing the methods and designs of the present invention. This home 68 has a side wall 70 comprising a plurality of posts or columns, which (in the view of FIG. 7) comprise two corner posts 50*a* and a plurality (five shown in FIG. 7) of wall posts or columns 50*b*. Between each adjacent pair of posts (50*a* and/or 50*b*) there are the wall sections 70, each made up of a plurality of timbers 52 stacked one on top of the other. There are several windows 74 formed in some of the wall sections 70.

FIG. 8 shows a front elevational view of the house 68. It can be seen that there are the two corner posts 50*a*. In addition, there are two posts 50*c* which are spaced on opposite sides of the front to rear center line 76 of the house, with these posts 50*c* reaching to an intermediate portion of one side 78 of the roof structure 80.

Then there is a center post 50*d* which extends all the way to the ridge line 82 of the roof 80. There are two lower story windows 74 of rectangular shape, a pair of doors 84, and some second story windows 86, some of which have trapezoidal shapes.

Figure 8H:
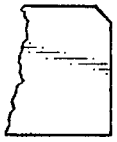
FIGS. 8H, 8I and 8J show portions of the timbers that are pre-cut.
Figure 8I:
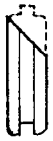
Figure 8J:
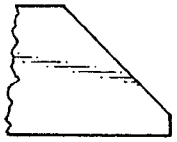

FIGS. 8A through 8G show wall sections that are made from pre-cut timbers, and FIGS. 8H, 8I and 8J show cuts that would be made at the factory location. These will be described later herein.

Figure 9:
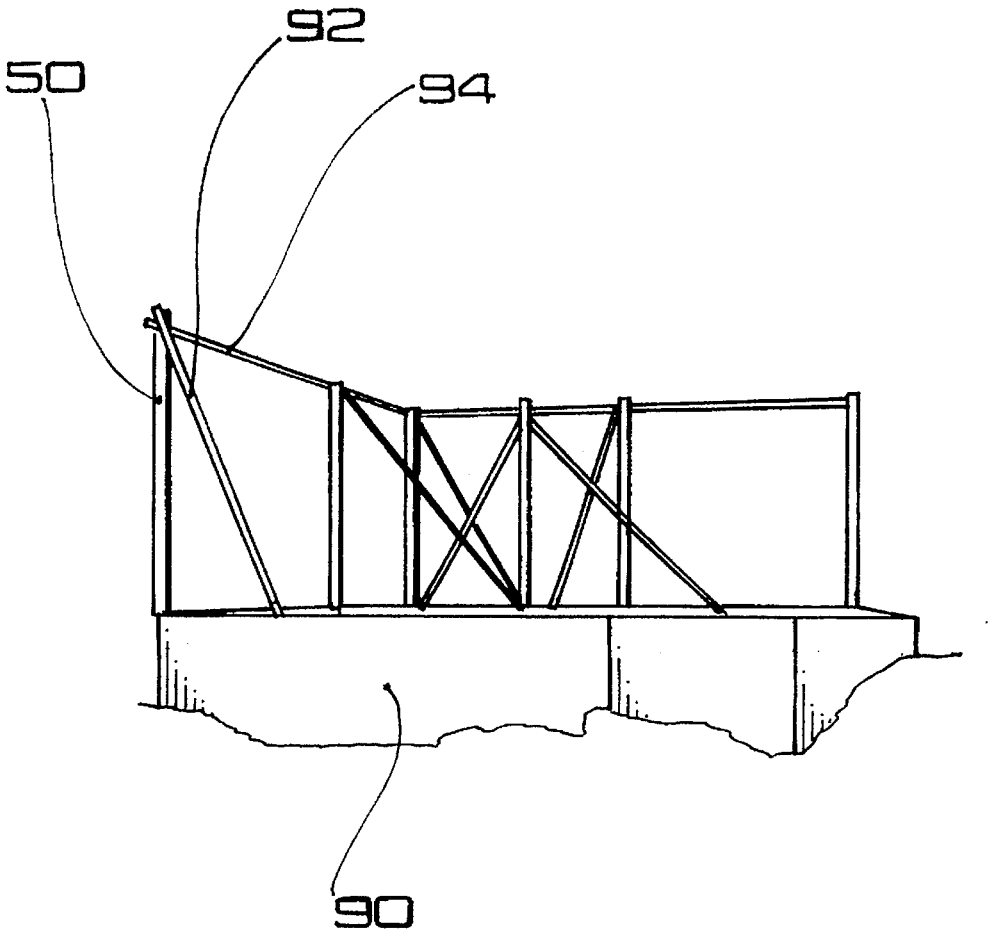
FIG. 9 is an isometric view illustrating one step in the method of the present invention where the columns are being erected on the base structure.
Figure 10:
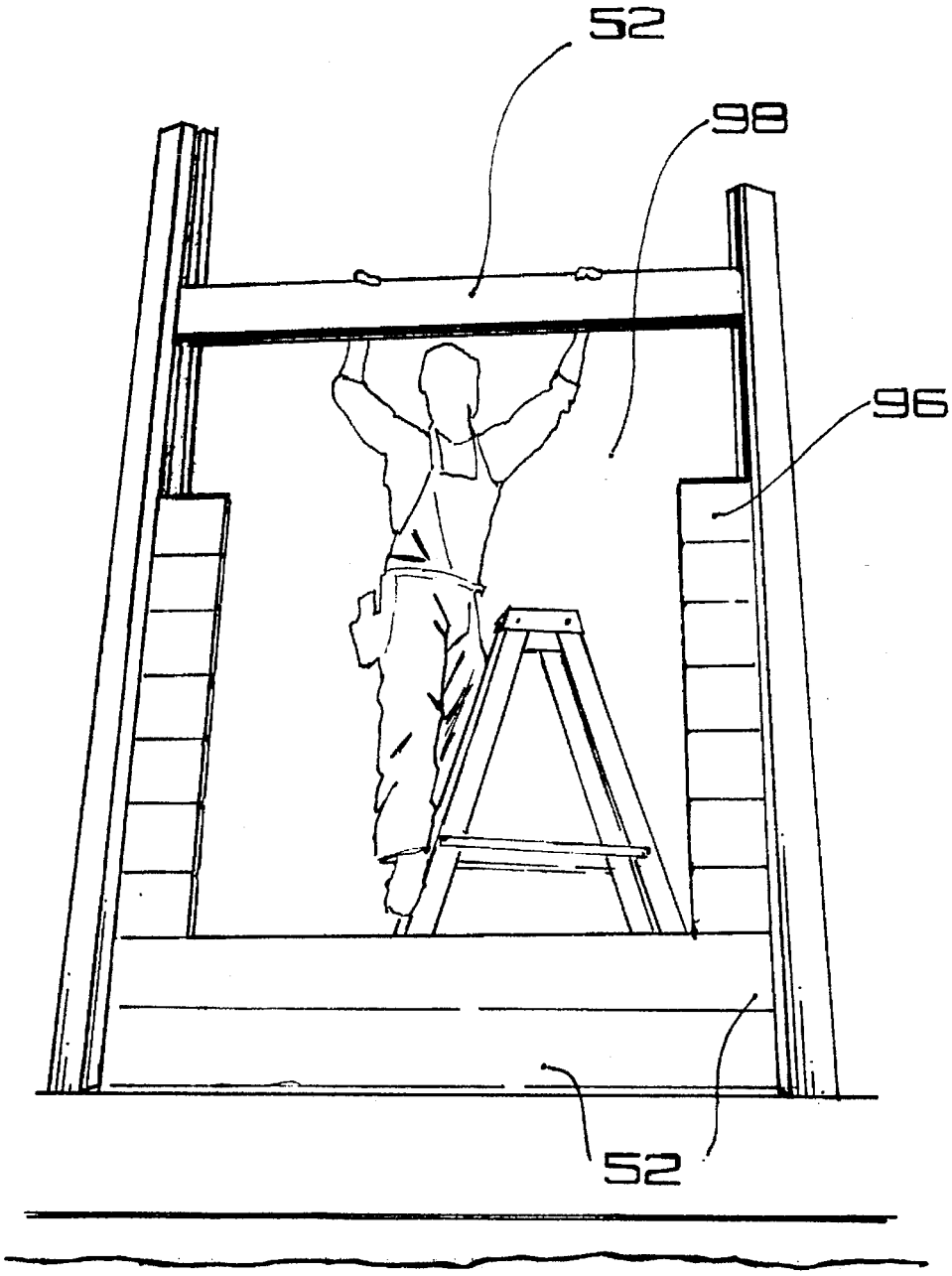
FIG. 10 shows another step of the method of the present invention where a wall section having a window opening is being erected.

FIGS. 9 and 10 illustrate some of the basic building steps utilized in the present invention. In FIG. 9, there is shown a house under construction, having the base structure 90 substantially complete. In the following text, the base structure 90 shall be considered the structure including the foundation, rim joist, floor joists, subfloor and the boards or other components that form the base structure up to the first floor level.

The first step in erecting the components above the base structure 90 is to erect the columns 50 at the proper locations. The various steps and precautions taken to ensure that these posts 50 are properly placed will be discussed in more detail in a following section of this text. When each post is properly positioned, it is held in place by a temporary bracing. As shown in FIG. 9, this can be accomplished by nailing wood 2×4s 92 to the top part 94 of the related column 50.

The columns 50 are initially made with greater length than is required for the building structure, and the topmost part 94 of the column 50 will be cut off. Accordingly, it is practical to nail the upper part of the 2×4 brace 92 into the upper end of the column 50 without defacing the part of the column 50 that will make up the end structure. Great care should be taken during this phase of locating and erecting the columns. If this done properly, then the subsequent steps of placing the timbers 52 will generally have virtually no difficulties.

The manner in which the timbers 52 are placed is illustrated in FIG. 10. Each timber 52 or 96 is precut to an exact length. The lower timbers 52 that extend between the two posts 50 have been put in place. Then there is a plurality of shorter timbers 96 which are installed at each column 50, these shorter timbers 96 defining a window opening 98. It can be seen that the workman is now establishing an upper timber 52 which defines the upper part of the window opening 98. In this manner the wall sections of the building structure are completed.

With this introductory portion of the text being completed, there will now be a discussion of each main section of the home structure, and the methods and designs utilized in the same.

C. Base Structure and Columns (FIGS. 11–14)

Figure 11:
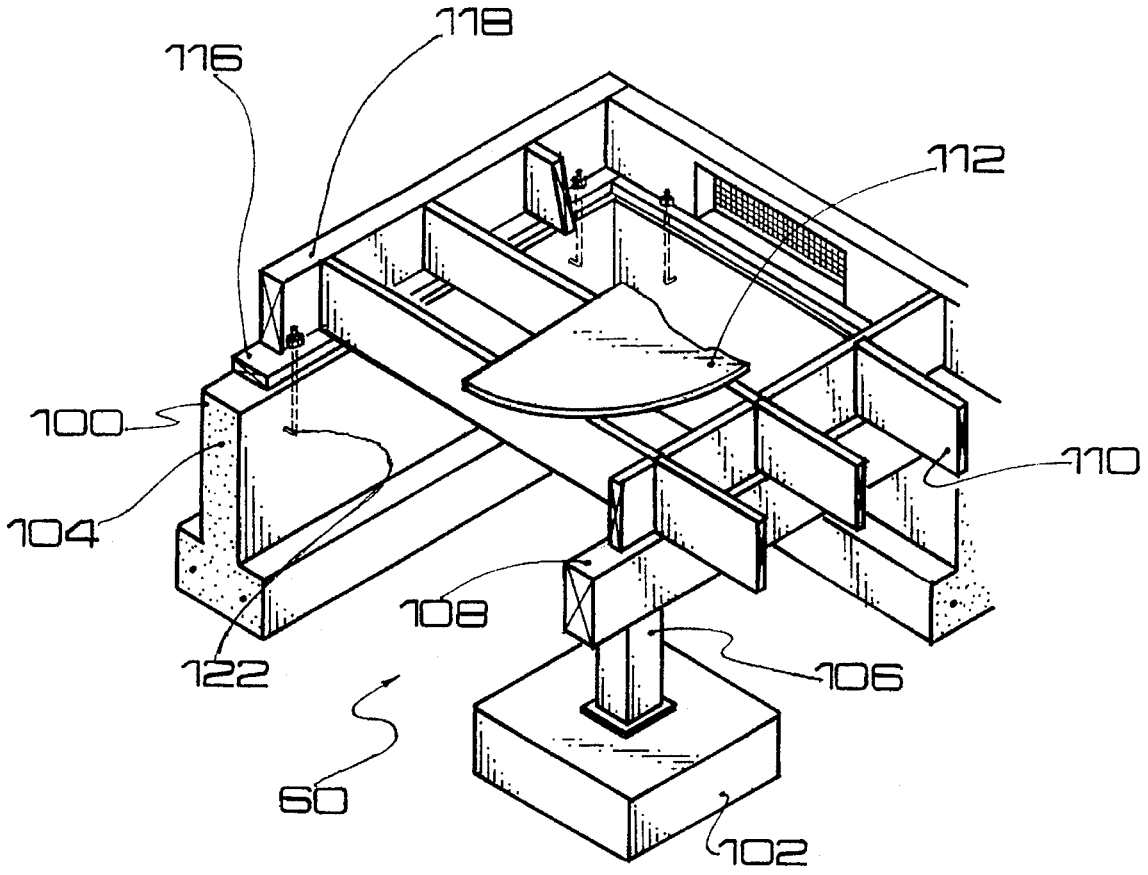
FIG. 11 is an isometric view illustrating a portion of the base structure constructed as an initial step in the method of the present invention.

FIG. 11 shows one corner portion of the base structure 60. Much of the base structure 60 is or may be of conventional design, with certain features being unique to the present invention.

As shown herein, there is a concrete foundation comprising a concrete perimeter wall 100 and concrete footings 102. Both of these can be of conventional design, and it can be seen that the foundation wall 100 is provided with continuous reinforcing bars around the entire perimeter, these being indicated at 104. A foundation post 106 rests on the footing 102 and a girder 108 extends over and rests on the foundation post 106. Floor joists 110 are supported from the perimeter footing wall 100 and directly from the girder 108. The sub-floor 112 is nailed to the floor joist.

Figure 12:
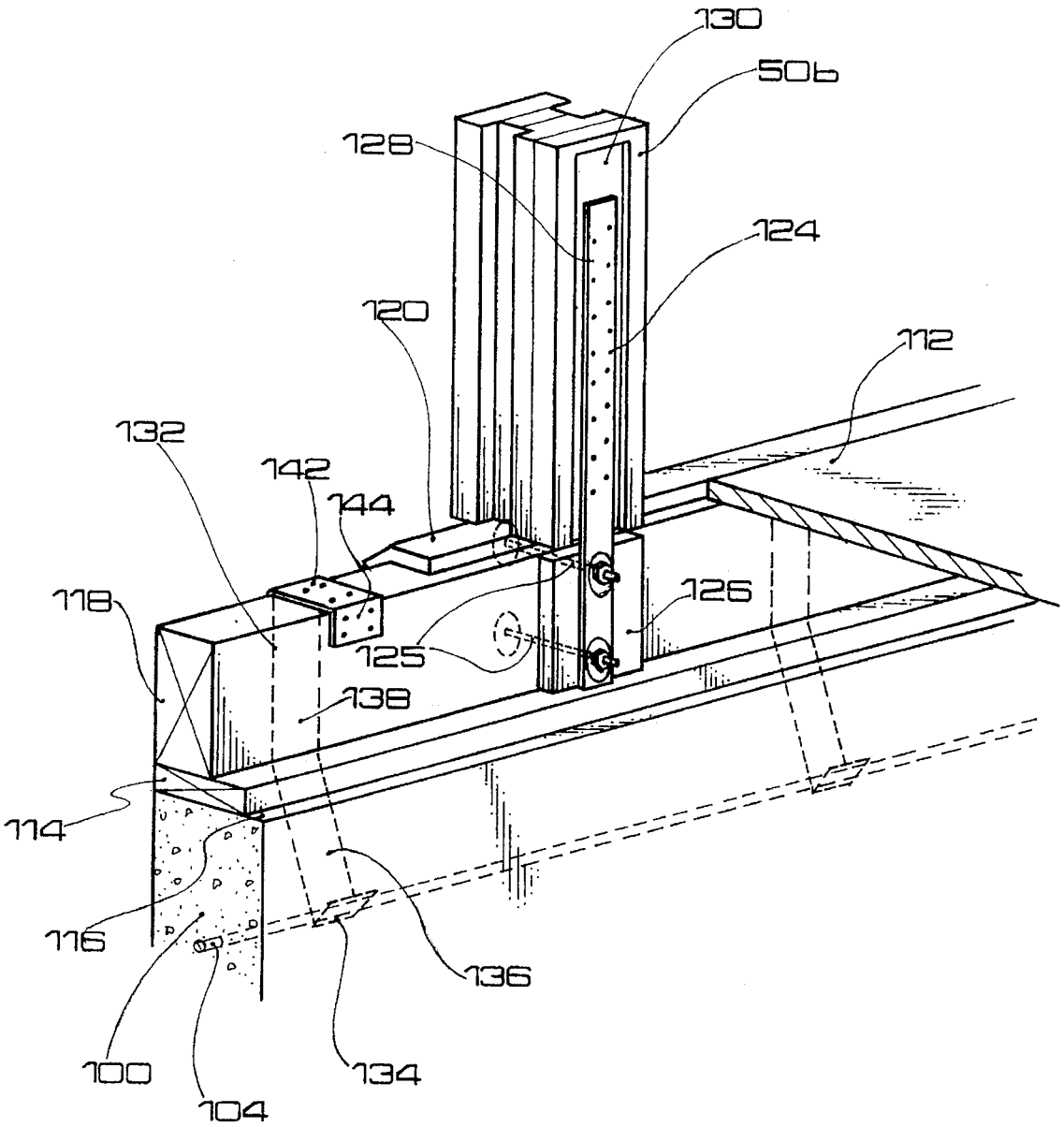
FIG. 12 is an isometric view illustrating the manner in which one of the posts or columns is mounted to and secured to the base structure along a straight line wall section.

Attention is now directed to FIG. 12 which shows a portion of the base structure 60 and a related column 50*b* at a straight wall location. There is a mud sill 114 (e.g. a 2"×6" wood plank) positioned on top of the top surface 116 of the foundation perimeter wall 100, and a rim joist 118 (e.g. a 4"×6" or 4"×8" timber) resting on the mud sill 116. A cedar wood drip cap 120 is positioned on top of the rim joist 118. As can be seen in FIG. 11, anchor bolts 122 are used to anchor the mud sill 114 to the foundation wall 110.

The post 50*b* is positioned on the drip cap 120 and the subfloor 112 extends under the column 50*b* to provide bearing support from the column 50*b* to the rim joist 118. A galvanized steel bar or strap 124 is bolted at 125 at its lower end to the rim joist 118, a spacing block 126 being used to properly position the lower end of the strap. The upper end 128 of the strap 124 fits in a shallow recess 130 formed in the inner surface of the column 50*b* and is nailed to the column 52*b*. Thus, it can be appreciated that the strap 124 securely holds the posts 52*b* against upward movement relative to the rim joist 118.

A significant feature of the present invention is the manner in which the rim joist 118 is secured to the foundation wall 110. This is accomplished in the present invention by providing a rigid metal strap or bar 132 (see FIG. 13A) that has a lower upturned end 134 that engages an upper reinforcing bar 104 embedded in the upper part of the perimeter foundation wall 100. From the hooked portion 134, the strap extends upwardly and outwardly at 136 to exit from the outer upper edge of the foundation wall 100. The strap 132 then has a straight vertical portion 138 that extends along the outside surface 140 of the mud sill 114 (See FIG. 13A) and the rim joist 118. The strap then extends horizontally inwardly at 142 over the rim joist and then has a down turned end flange 144 which extends over the upper inner edge of the rim joist 118.

The strap 132 is placed in position in the area of the concrete footing wall 100 at the time the reinforcing bar 104 is put into place, and the concrete for the foundation wall 100 is poured around the lower strap portions 134 and 136. The upper portions 136, 142 and 144 of the strap 132 have openings therein to receive nails by which the strap 132 is secured to the rim joist 118. When the rim joist 118 are initially placed in position on top of the mud sills 114, the upper surface of the rim joist 118 that is positioned immediately below the strap portion 142 can be chiseled out to some extent so that the upper surface of the strap portion 142 is flush with the top surface of the rim joist 118.

Figure 13:
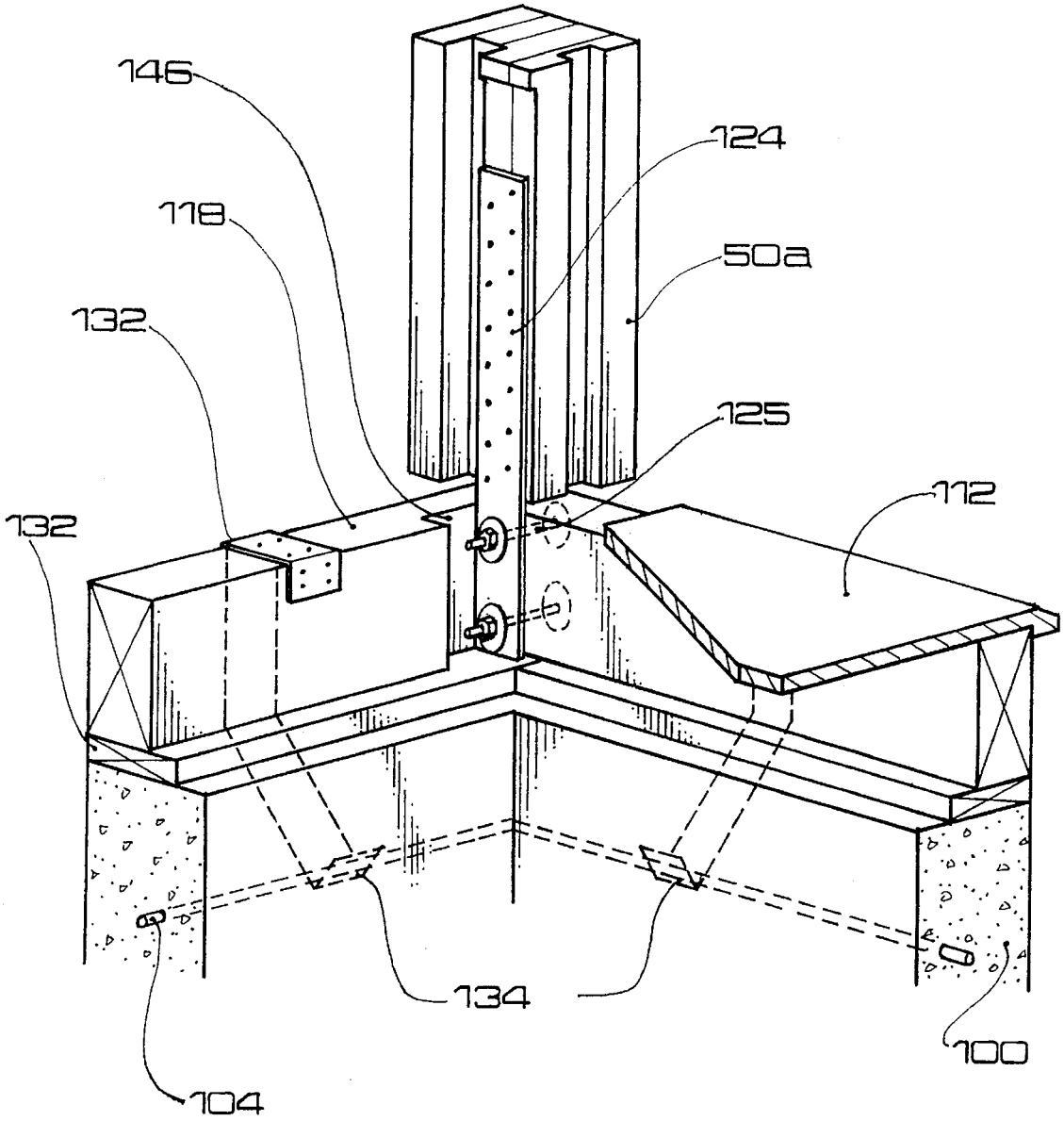
FIG. 13 is an isometric view similar to FIG. 12, showing the manner in which a corner is column is positioned at and secured to the base structure.

Reference is now made to FIG. 13 which shows a corner portion of the base structure 60 at which a corner column 50*a* is mounted. It can be seen that there is the foundation wall 100, mud sill 114, rim joist 118, and the restraining strap 132. Since these were described above with reference to FIG. 12, a detailed description of these will not be repeated relative to FIG. 13.

Figure 14:
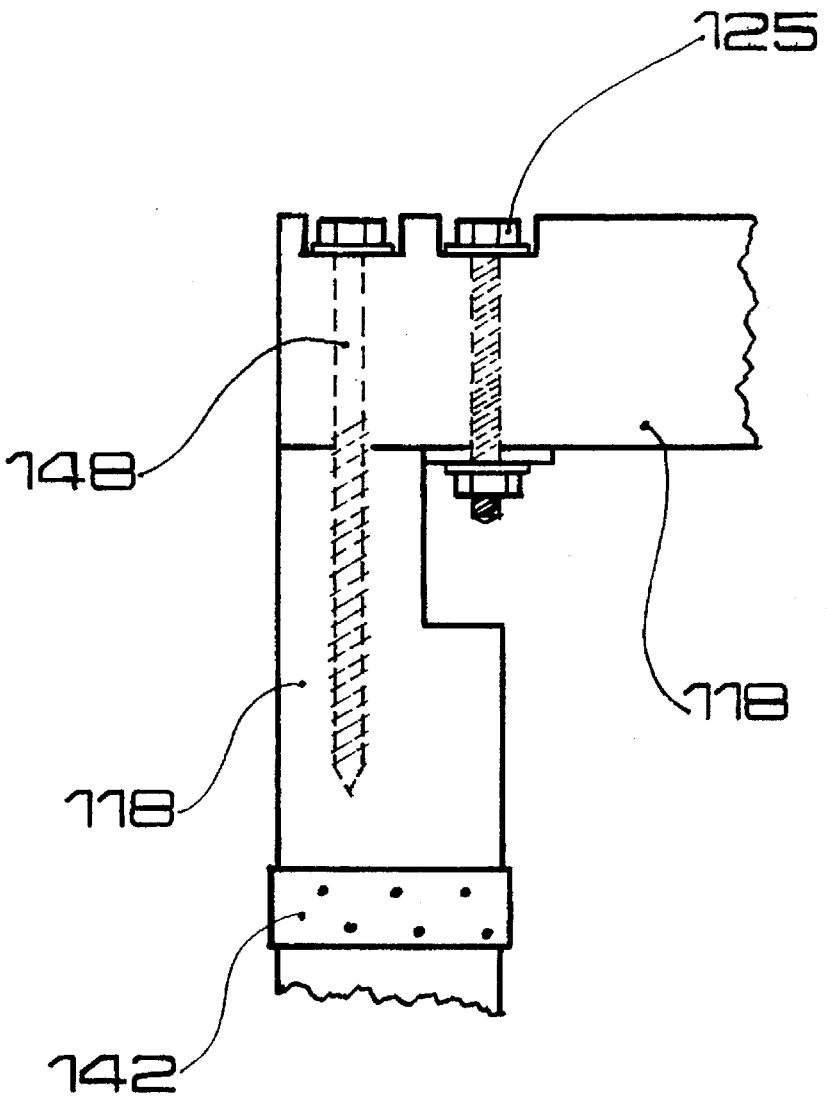
FIG. 14 is a sectional view taken in horizontal section illustrating the manner in which two rim joists are secured to one another and a retaining strap for the corner column is secured to the rim joist.

However, the positioning of the column strap 124 is somewhat different, in that an end corner portion 146 of the rim joist 118 is cut out to permit the strap 124 to be positioned in that cut out area. This cutout 146 is also sufficiently large to permit bolts 125 to be inserted from outside the other joist 118 and into the cutout area 146, and also permit the nuts to be threaded on to the bolts 125. Also, as can be seen in FIG. 14, the rim joist 118 which extends all the way to the corner has a long galvanized lag bolt 148 extending therethrough and into an adjacent portion 150 of the other rim joist 118.

While not shown in FIGS. 12 and 13, it is to be understood that the mud sill 120 and the adjacent portions of the sub-floor 112 extend underneath the columns 50*a* and 50*b* to provide direct bearing support from those lower column portions into the structure below.

It is important to note that great care should be taken in properly placing the columns 50 at the precisely correct location, and also making sure that these remain plumb throughout construction. As indicated previously, if this is done, the later placing of the timbers 52 to make the wall sections will encounter little, if any, difficulty. One technique for accomplishing this is as follows. As mentioned previously, normally the columns are provided at the building site somewhat overlength. It is recommended that the lower half inch or inch of the column be carefully cut off so that the bottom surface of the column 50 is exactly perpendicular with the lengthwise axis of the column 50. During the initial layout, each of these cut-off end pieces of the column are placed at their designated location on the subfloor 112 and the drip cap 120 and temporarily secured in place. Then the lowermost wall beams 52 are placed entirely along the timber wall locations of the building to make sure that these properly fit within the column slots 58. After this, the location of each of the column pieces is precisely marked on the subfloor 112 and drip cap 120 so that these can later be located for erection of the columns 50.

After the columns 50 have been erected in their vertical locations, but before being permanently secured in place, the same procedure is again followed of placing the lower course of timbers 52 throughout the perimeter of the building to make sure there is a proper fit. Of course, if there are any of the interior walls made with the timbers 52, the same procedure is followed for those walls.

D. Erecting the Wall Sections (FIGS. 15–21)

After the columns 50 are properly erected and secured in place, the wall timbers are put into place. As indicated previously with reference to FIG. 10, the timbers 52 are usually installed by lifting these up to the top of the columns 50, aligning the timber with the column slots 58, and then lowering these into place. Also, as indicated in the section immediately above, it is desirable that the entire first course of the lowermost timber be placed entirely throughout the building structure, to make sure there has been no mistake in positioning the columns 50.

Each timber 52 is both bonded to (by glue or other adhesive composition) and mechanically fastened to (generally by screws) to both the adjoining columns 50 and also the immediately adjacent timbers 52 (those immediately above and below). In addition, the lowermost timber 52 is both bonded to, and mechanically connected to, the rim joist 118 immediately below.

Figure 15:
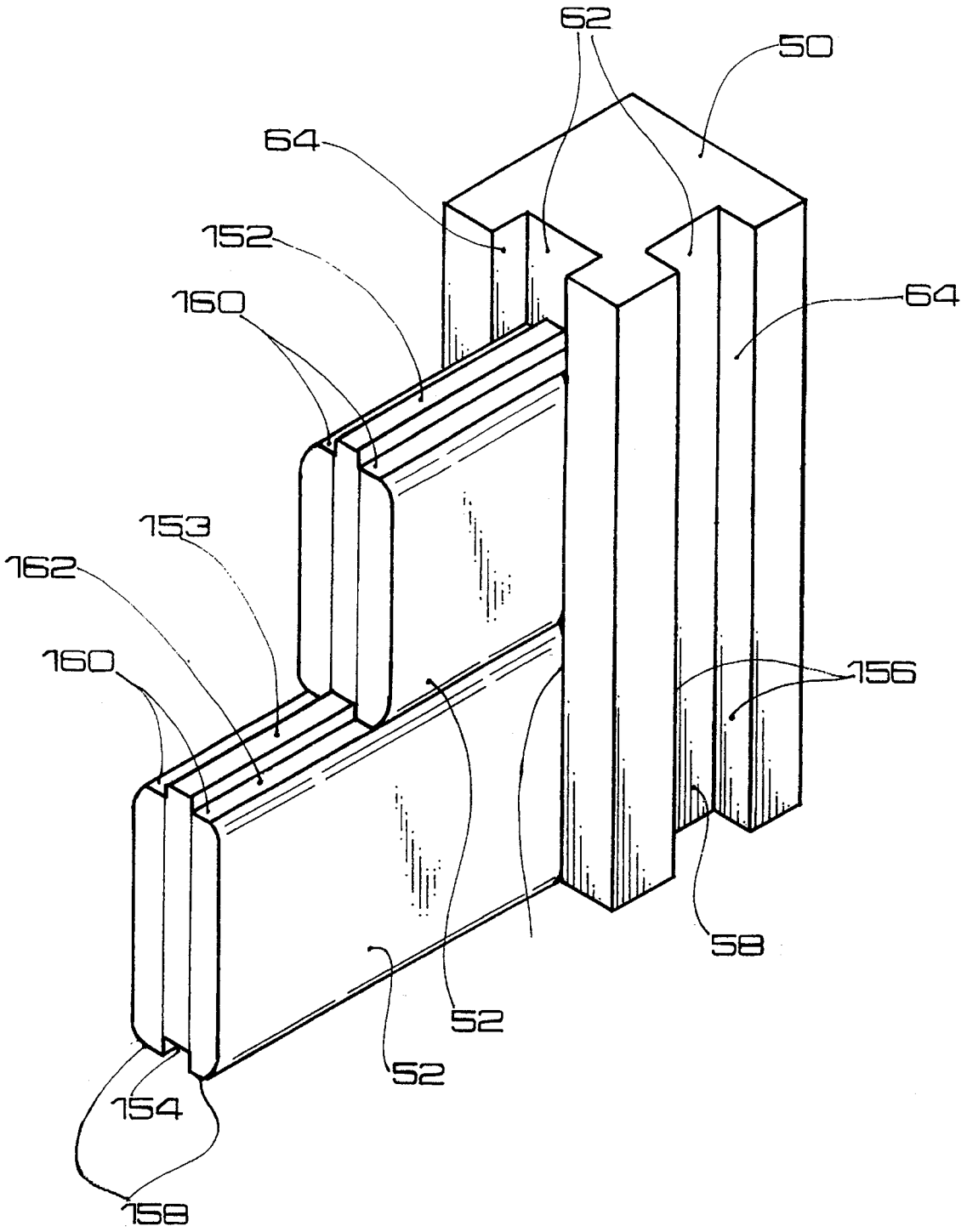
FIG. 15 is an isometric view illustrating the manner in which an adhesive composition is applied to the timbers and to the columns during erection.

Reference is made to FIG. 15 to indicate the locations where the glue is applied. Initially, before any timber 52 is put into place, glue is applied (as shown at 156) to all three surfaces 62 and 64 of the slot 58 at the location where the timber 52 is to be placed.

Also, in starting the lowermost timbers 52 (i.e. the starter course), heavy beads of glue are applied to the base structure surface, as indicated at 158. Then the first course of timbers 52 are put into place. When the next upper timber 52 is to be placed in the wall section being erected, first the glue is applied to the three interior surfaces 62 and 64 of the slot 58. Also, two beads of glue are placed (as indicated at 160) along the two surfaces 162 alongside of the upper elongate ridge 53. When the next timber 52 is lowered into place, the contact of the timbers 52 will spread the glue over these surface areas 162. Various commercial adhesive compositions would be suitable, one such composition sold as "Scotch Grip No. 5230" which is supplied by the 3M Company. After all the timbers 52 are in place, then a fine finish grade bead is applied to all exterior vertical seams before staining, this being indicated at 164.

Figure 16:
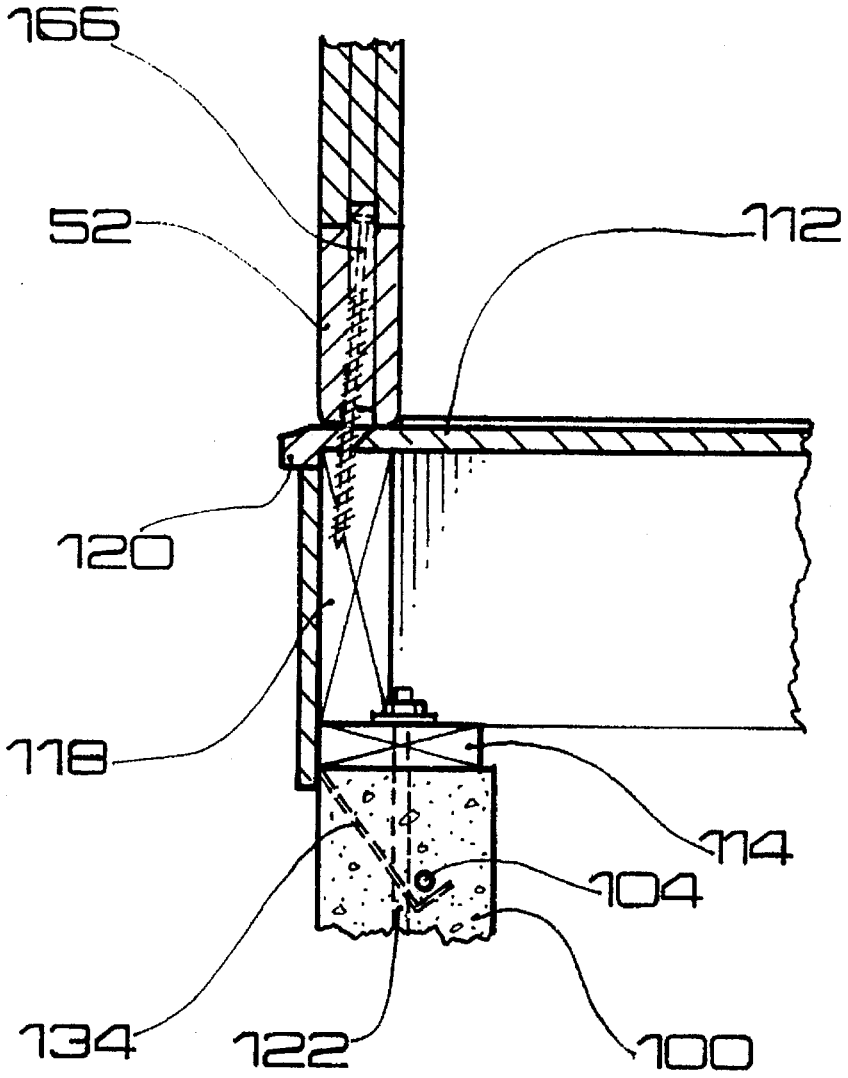
FIG. 16 is a vertical sectional view illustrating a wall column and two adjacent wall sections, and showing the manner in which screws are utilized to join the components.

With regard to the manner in which the base course of beams 52 is connected to the joist 118 immediately below, reference is made to FIG. 16. After the first course of timbers 52 is laid in place, long lag screws 166 as shown in FIG. 17A are inserted downwardly from the top surface of the lowermost timber 52 to extend through the drip cap 120 and into the rim joist 118.

Figure 17:
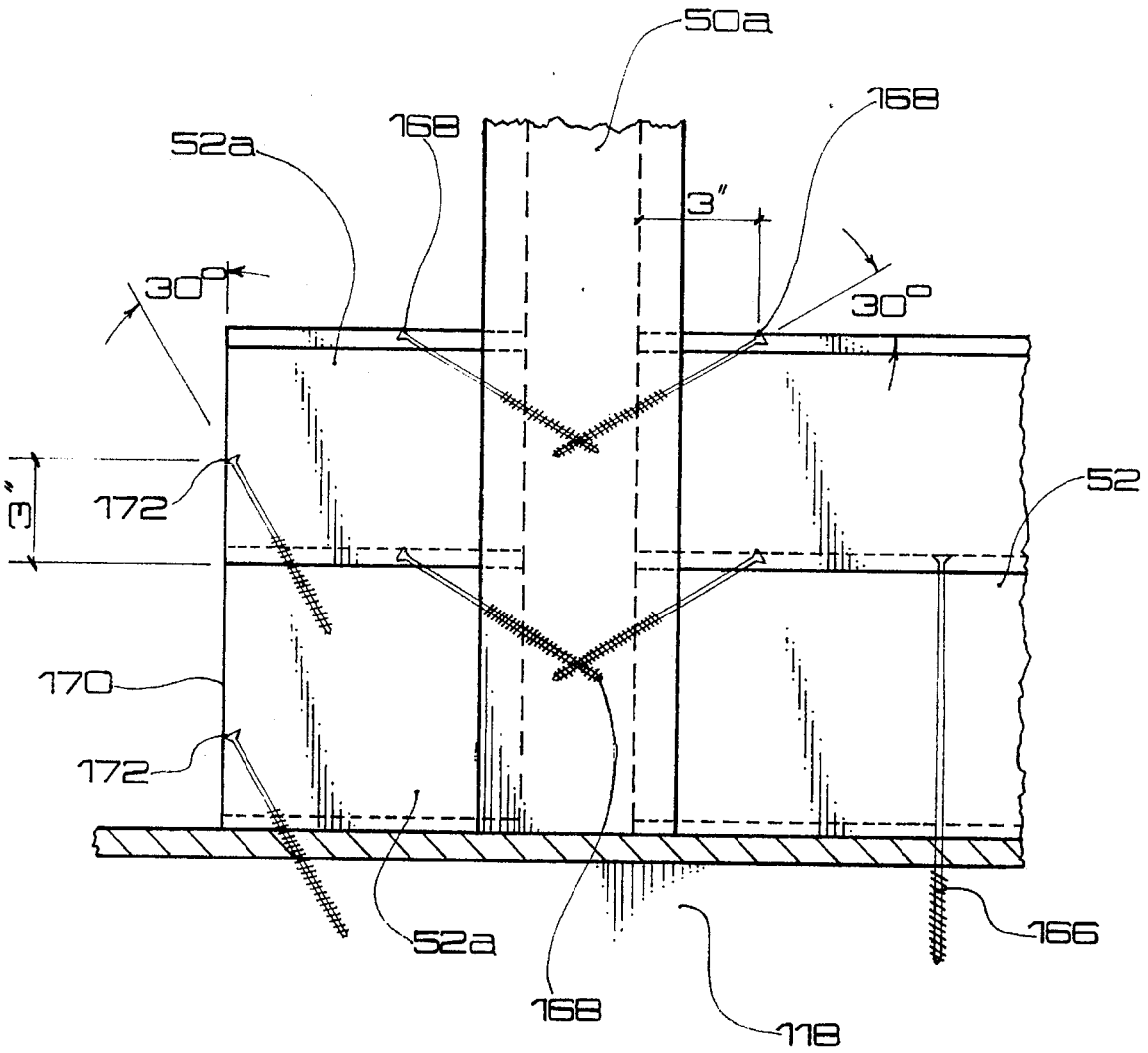
FIG. 17 is a vertical sectional view taken parallel to a horizontal lengthwise axis of a wall section, showing the lower two timbers of the wall, and the upper portion of the adjacent base structure.
Figures 17A, 17B:
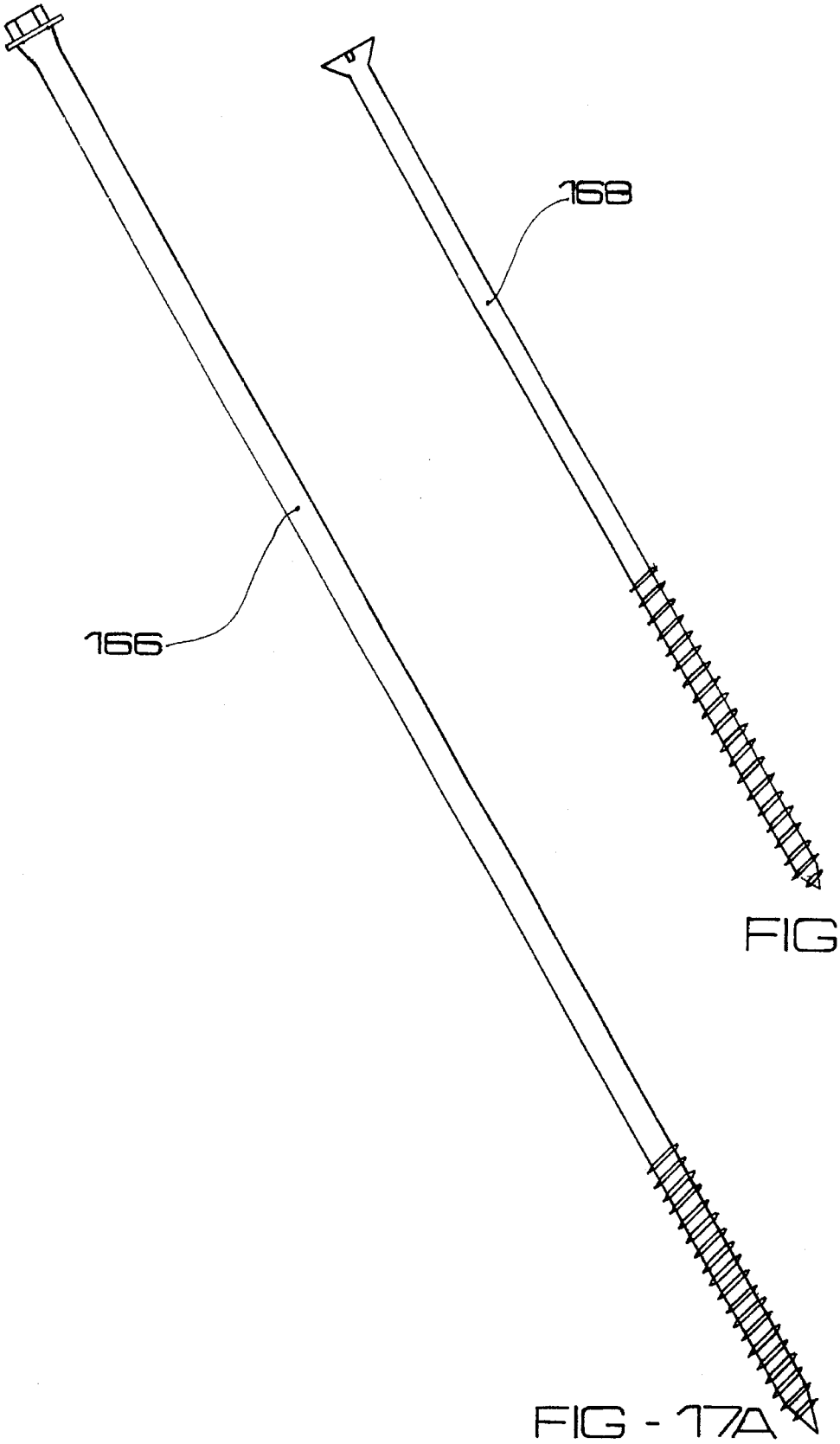
FIG. 17A is a side elevational view of a longer self-tapping screw used in the present invention.
FIG. 17B is a view similar to 17A showing a shorter self-tapping screw used in the present invention.

In FIG. 17, the manner in which the timbers 52 are mechanically connected by screws 68 (one being shown in FIG. 17B) to the adjacent column 50 is illustrated. After each timber 52 is put into place, then a tapping screw 168 (6" galvanized) is inserted through the top center surface portion of an end portion of the timber at a 30° angle from the horizontal and into the column 50. These screws 166 and 168 function in a manner to drill out at least part of the opening into which they fit.

In addition, in some instances after the timbers 52 are put into place, it is necessary to cut an opening, such as for a door. In this instance, the portions of the wall timber 52*a* that still remain may not have the mechanical attachment, such as shown in FIG. 17 at 166. In this instance, a self-tapping screw 172 is inserted through the lateral vertical surface 170 of the lowermost timber 52*a* into the rim joist immediately below, with the angle of the screw 172 being at 30° from the vertical. Then the next timber 52*a* immediately above is attached by a self-tapping screw 172 inserted in its sidewall 170 to the next lower timber 52*a*.

Figure 18:
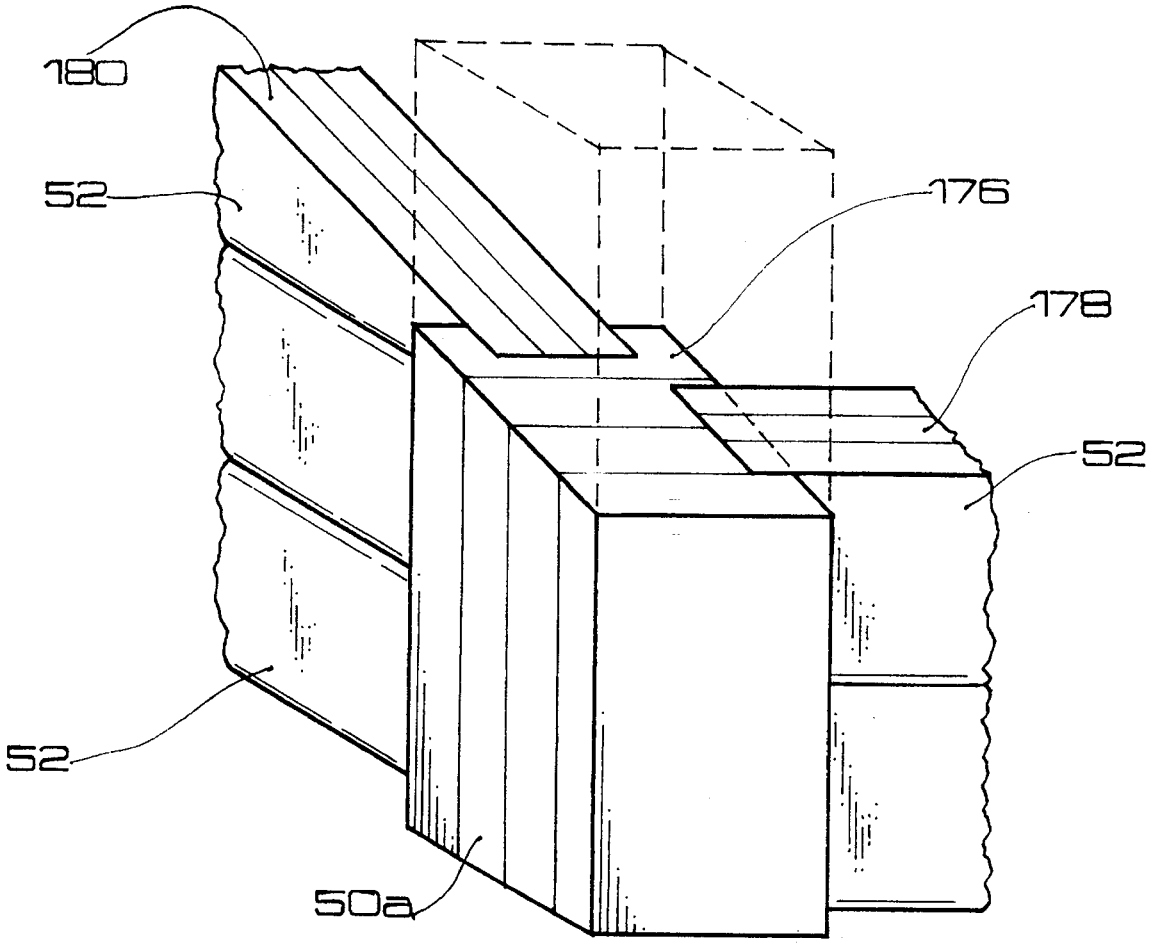
FIG. 18 illustrates a top end portion of a corner column, having the upper surface cut at a slant to facilitate roof construction.

After the wall sections 70 are completed, then the top end 174 of each column 52*a* that is to be adjacent to a slanted roof beam of the roof is cut off to leave a slanted surface 176 (See FIG. 18). Also, the adjacent upper surface 178 of the topmost timber 52 can also be sawed to a slanted configuration. More desirably, this slanted surface 178 would be given to the topmost timber 52 when all the timbers are being precut at a shop or manufacturing location. Further, the other top timber 52 may be pre-cut to have a sloping surface 180 along the lengthwise axis of the timber that follows the roof contour.

Figure 19:
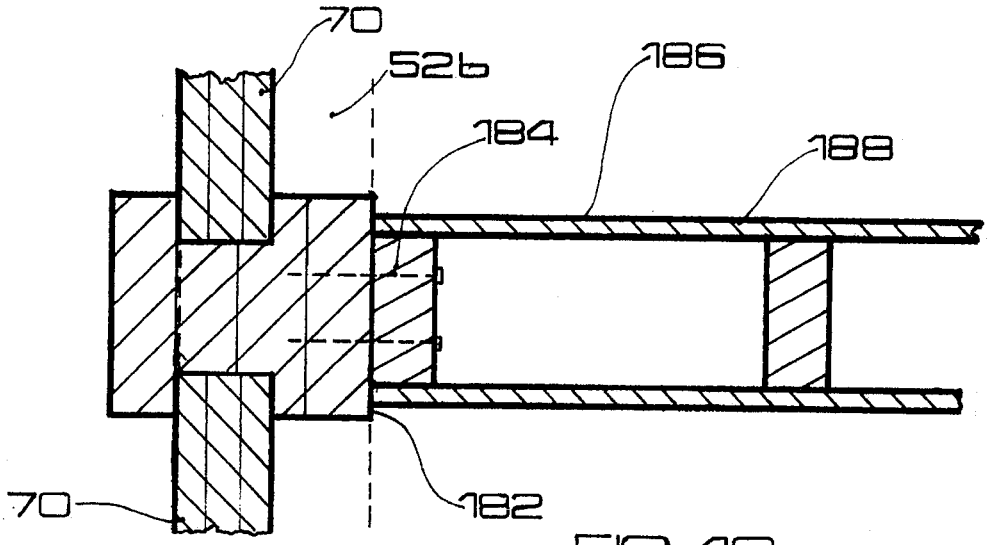
FIG. 19 is a horizontal sectional view illustrating a wall column and a portion of a conventional framed wall section joined to the column.

One of the benefits of the design of the present invention is that it readily lends itself to being combined with interior walls of conventional frame construction. This is illustrated in FIG. 19 where there is shown a wall beam 50*b* connected to adjoining timber wall sections 70. At the interior surface 182 of this column 50*b*, it is desired to attach a wall of conventional framing. This is accomplished by placing the end vertical wood 2×4 stud 184 of the wall section 186 adjacent to the interior column surface 182 and nailing this vertical 2×4 directly to the column 50*b*. The 2×4 framing of this wall section 186 can be accomplished in the conventional manner. As shown herein, this wall section 186 comprises a plurality of 2×4s with wall panels 188 (e.g. wall board) nailed or otherwise secured to the 2×4 framing.

Figure 20:
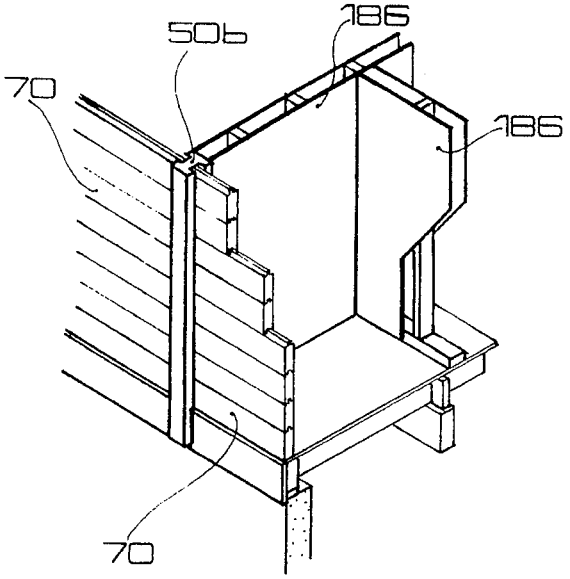
FIG. 20 is an isometric view illustrating a wall section of the present invention, where the column is joined to an interior wall made in accordance with conventional framing procedures.

FIG. 20 is an isometric view illustrating two adjacent wall sections 70, with an interior conventional wall 186 connected to the column 50*b* and extending into the interior of the building. Also, an additional wall conventional framing 186 is shown as being attached to the first wall 186.

Figure 21A:
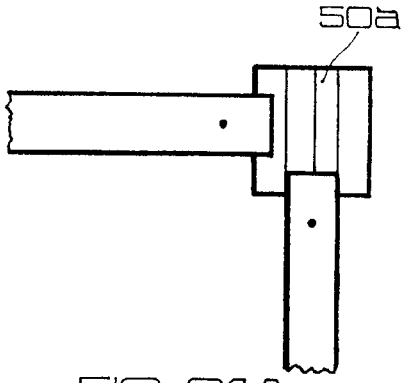
FIGS. 21A, 21B, 21C and 21D are horizontal sectional views illustrating four different ways in which two walls can be joined to a column, in accordance with the present invention.
Figure 21B:
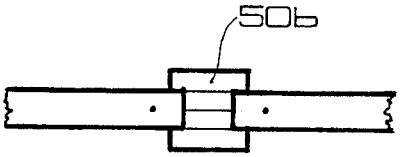
Figure 21C:
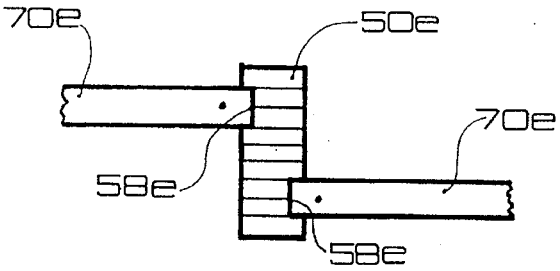

Another feature of the present invention will now be discussed with reference to FIGS. 21A, B, C and D. In FIG. 21A, there is shown the corner column 50*a*, and in FIG. 21B, the wall column 50*b*. The method of utilizing these has been discussed previously herein.

However, in some instances, it may be desirable to have a jog in a wall. If so, then this can be accomplished by providing a column 50*e* which is made with additional laminations so as to have a much longer width dimension. Thus, the vertical slots or grooves 58*e* can be made at spaced locations, relative to the planar alignment of the two wall sections 70*e*.

Figure 21D:
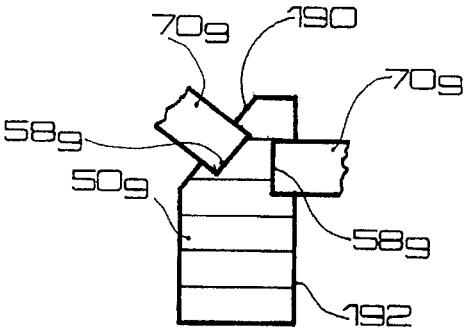

Another modification of the column configuration is shown in FIG. 21D, where there is shown a column 50*g* which joins two wall sections 70*g* at a 135° angle. This is accomplished by bevelling one corner at 190 of the column 50*g*, and then forming one of the vertical slots 58*g* on the bevelled face 190 in a manner so that the one wall 70*g* shall be at the 135° angle. The other slot 58*g* is made perpendicular to the sidewall surface 192 than is part of the rectangular cross-section of the column 90*g*.

E. Wall and Corner Trim, and Additional Panel Construction

In some instances, the homeowner may wish to cover certain portions of the house with paneling having a surface other than the natural wood surface of the timbers 52. Also, in providing such different interior wall surfaces, it may be desired to add insulation. The manner in which this can be accomplished is illustrated in FIG. 22.

Figure 22:
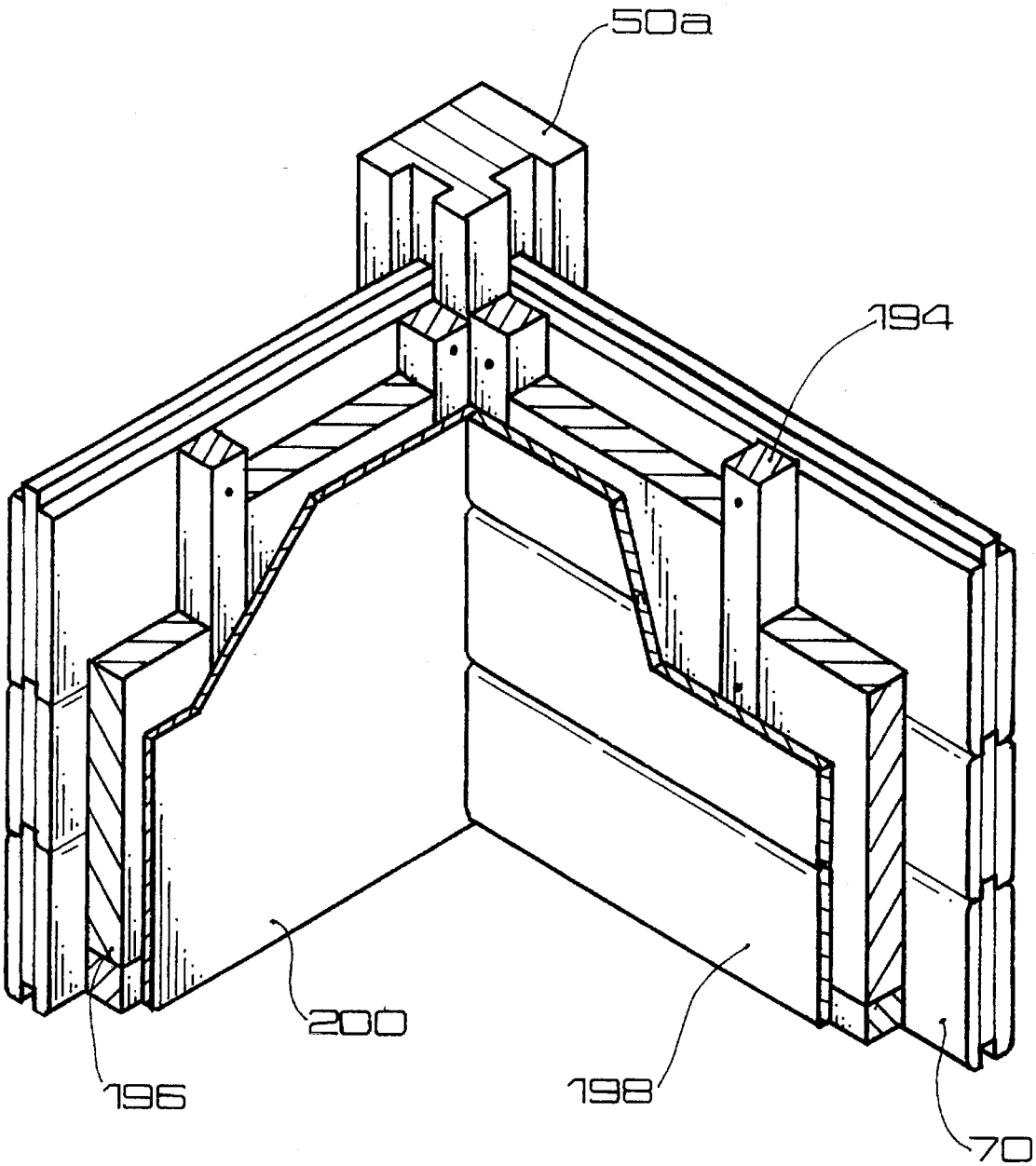
FIG. 22 is an isometric view of the corner section of the present invention, showing where an additional interior wall is being constructed at the interior surface of the timber wall.

In FIG. 22 there is shown an inside panel/insulation construction at a corner location. There is the corner column 50*a* and two wall sections 70 joined thereto. First, a plurality of elongate wood pieces 194 (e.g. furring having a 1½"×1⅞" cross section) is provided, and each piece 194 nailed to the interior surface of the wall 70. Then the insulation panels 196 are put into place between the furring strips 194, after which the interior surface siding is applied. This could be, for example, wood veneer panels (shown at 198) or sheetrock (indicated at 200).

Figure 23:
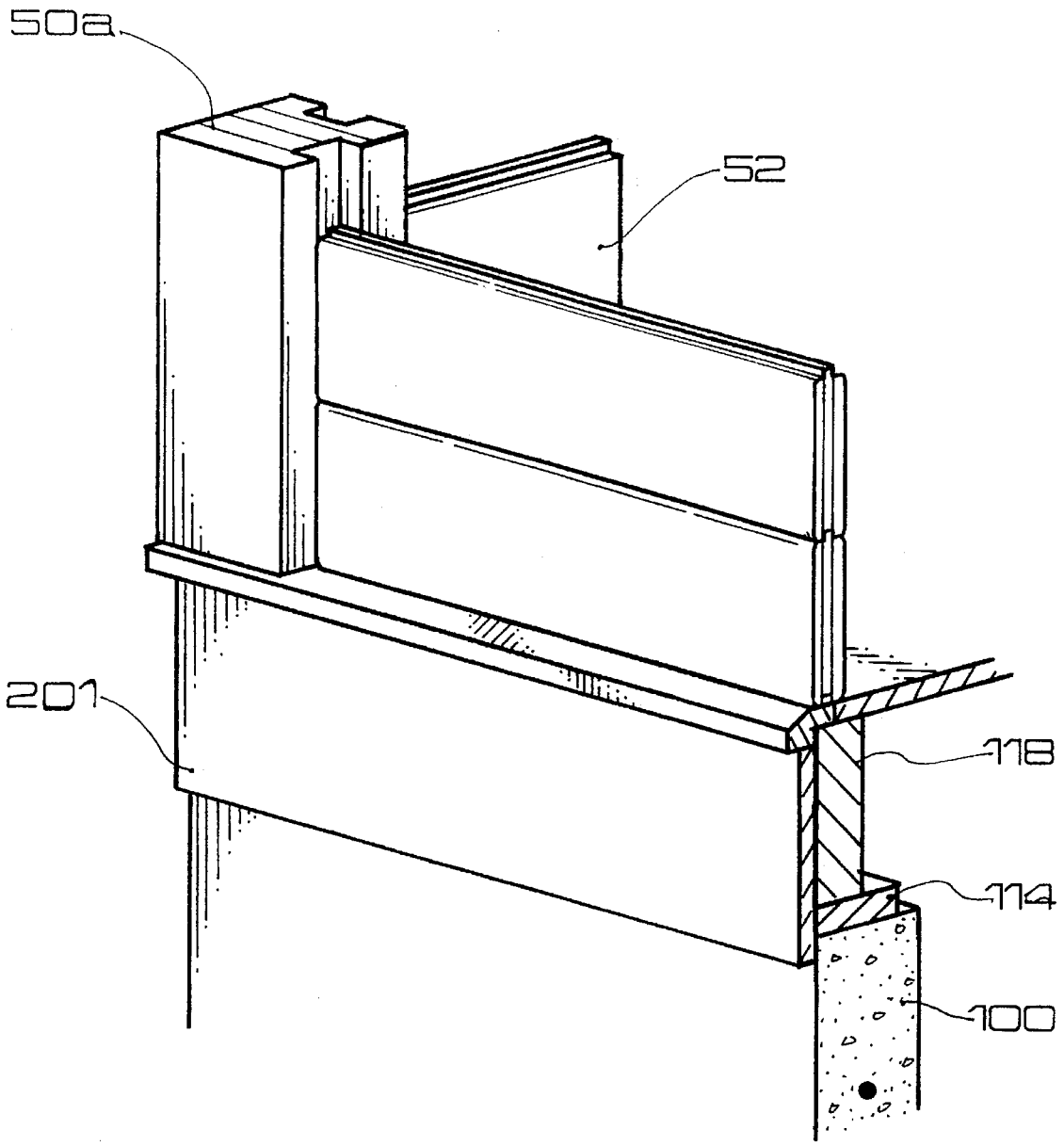
FIG. 23 is an isometric view taken of a corner section from a location outside of the structure, and illustrating the exterior appearance of the building at that corner.

FIG. 23 shows the manner in which the exterior of the lower part of the building structure might be finished. There is shown a piece of base trim 201 which has a sufficiently large width dimension so that when positioned just beneath the outer edge of the drip cap 120, the base trim 201 extends sufficiently far down to conceal the rim joist 118 and the mud sill 114.

Figure 24:
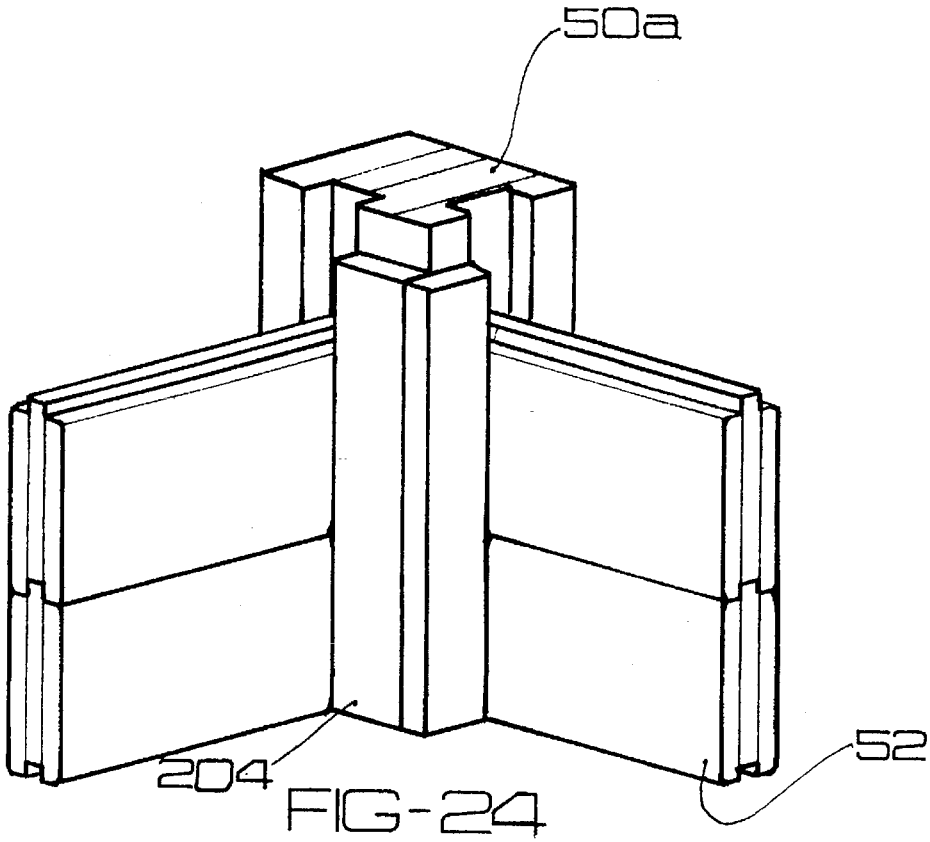
FIG. 24 ms a view of an interior corner, and illustrating the facing material applied to the corner column.

In FIG. 24, there is shown how the interior exposed surface of the corner column 50*a* might be covered. This is desirable, for example, where the connecting strap 124 might be exposed. This is conveniently accomplished by providing two elongate pieces of wood, which could be one inch cedar strips that are applied to the interior facing of the column, these being shown at 204.

Figure 25:
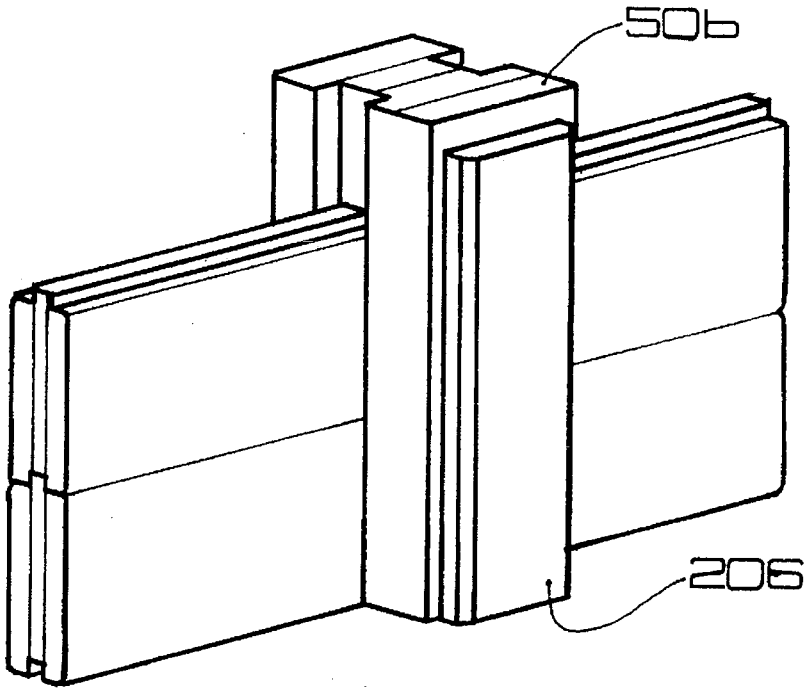
FIG. 25 is a view similar to FIG. 24, but illustrating the facing material applied to a wall column.

In FIG. 25, there is shown a wall column 50*b*, and this may also have an interior strap 128 exposed. If so, then this can simply be covered by applying a piece of trim 206 (a one inch thick board) which would be applied to the interior surface of the column 50*b*. These trim pieces 204 and 206 would likely be cut to size at the actual building site.

F. Windows and Doors (FIGS. 26, 27A and 27B)

As indicated previously herein, usually the timbers 52 are precut so that when these are assembled, to erect the wall 70, the window opening will be present (this indicated at 98 in FIG. 10). To install the window (see FIG. 26), the first step would be to nail in a 2×4 frame 208, with nail locations being indicated at 209. There is shown a part of a lower sill 210, and also a vertically extending buck 212. With this frame 208 installed, then conventional techniques can be used for completing the installation of the window.

Figure 27A:
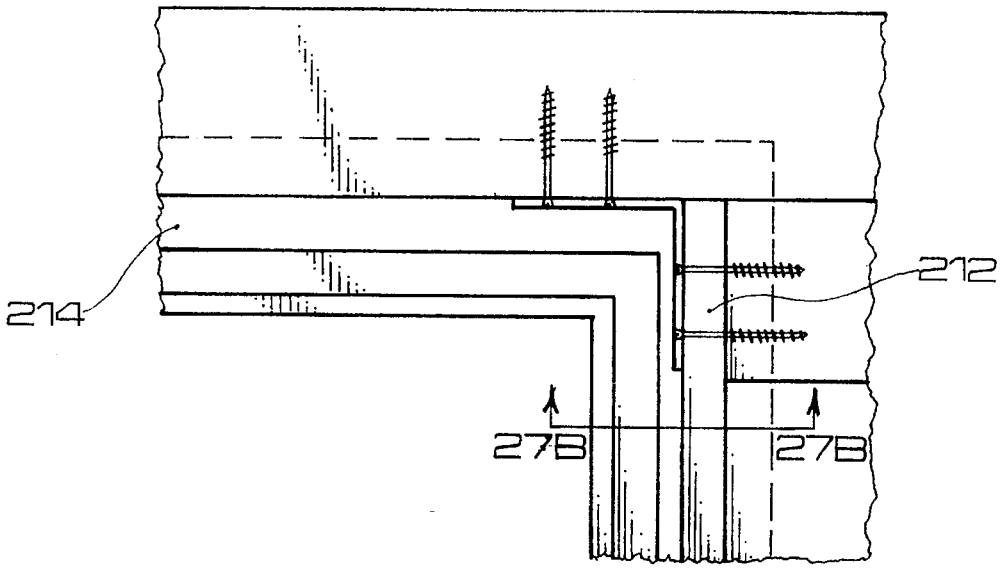
FIG. 27A is an elevational view of a top corner section of a door formed in the wall of the present invention.
Figure 27B:
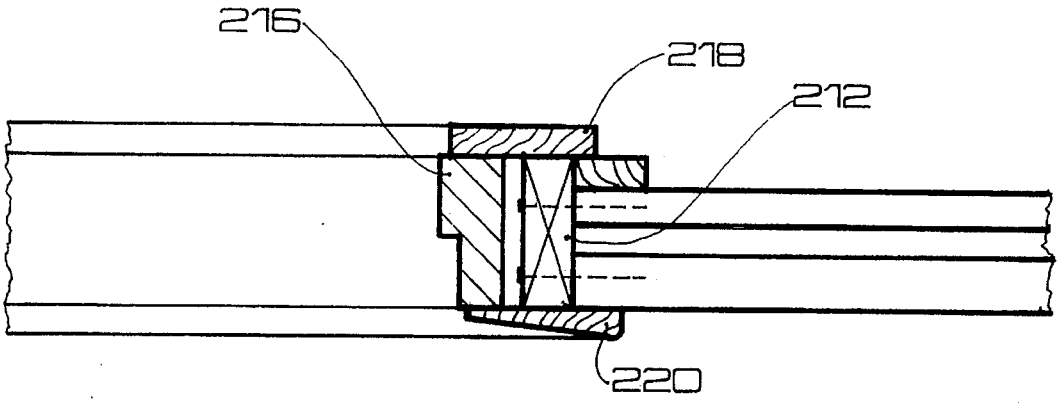
FIG. 27B is a view taken along 26A illustrating the cross-sectional configuration of the door frame.

FIGS. 27A and 27B illustrate the manner in which the door opening can be framed in. Normally, for purposes of properly aligning the columns 50 Of the building structure, the lowermost timber 52 that extends through a doorway area will not be precut to provide for the door opening. Then after this lowermost timber 52 is put into place and the wall erected, then that portion of the lowermost timber 52 that is at the location of the door will be cut to provide the lower part of the door opening.

Figure 26:
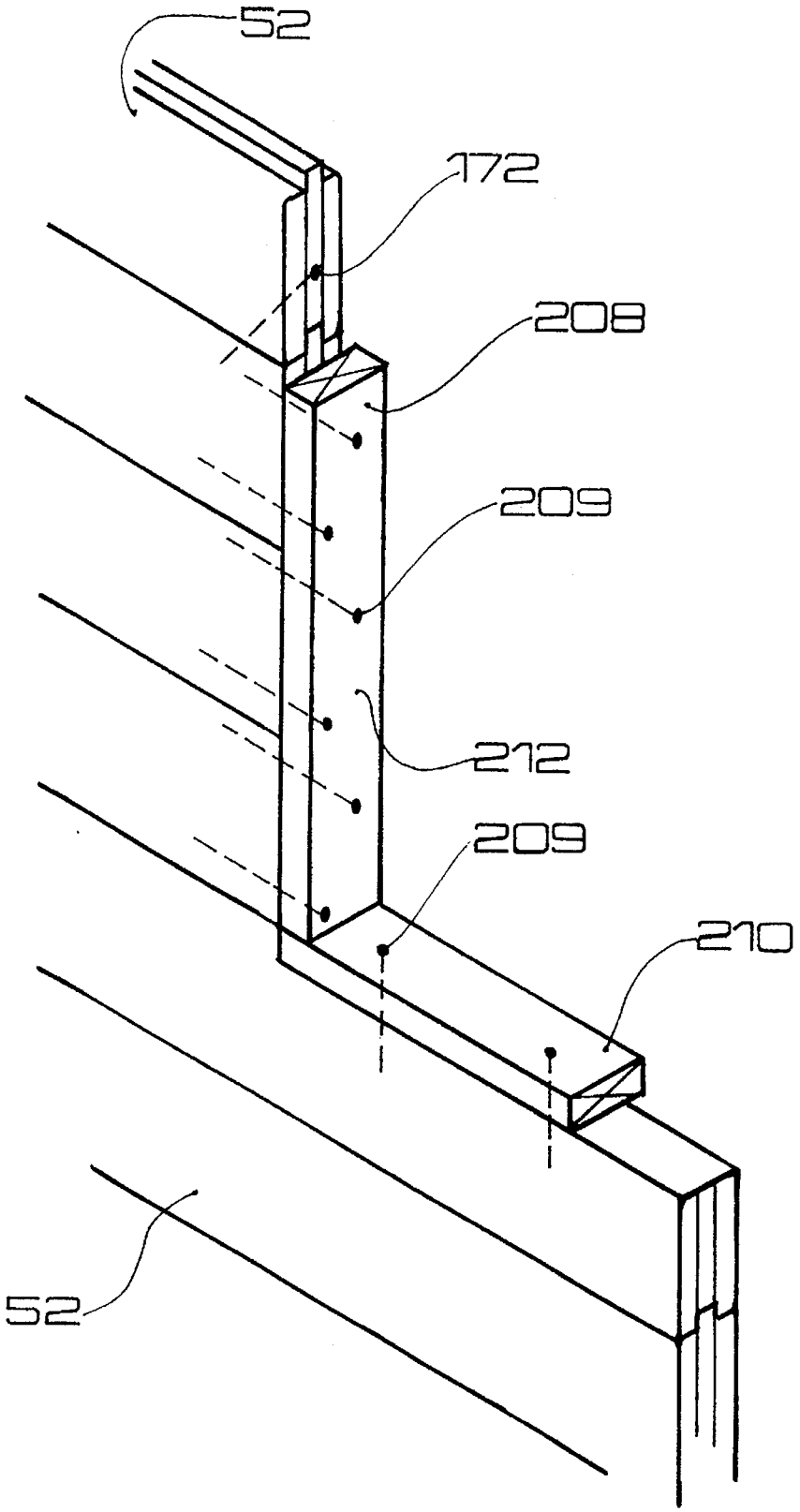
FIG. 26 is an isometric view illustrating the manner in which a window in the timber wall structure is framed.

To install a door in the door opening, the first step is to provide a wood 2×4 (or larger) frame around the side of the doorway, this is done in somewhat the same manner as providing for the window frame (see FIG. 26). FIGS. 27A and 27B show the 2×4 frame, with the vertically aligned buck beam shown at 212, and the top 2×4 member being indicated at 214 joined to one another by a right-angle-shaped reinforcing piece 215. The door jam 216 is nailed in place, and exterior and interior trim is provided at 218 and 220. The door itself and the remaining items can be added in accordance with conventional construction techniques.

G. Loft, Second Story and Roof

In the house shown in FIGS. 7 and 8, the structure is provided with a loft. Also, the house can be provided with a full second story. In either instance, the timber construction of the present invention can be utilized. For example, as shown in FIG. 8 (showing the front of the home), the columns 50*c* and 50*d* extend all the way to the roof, and the timbers 52 form the wall surface all the way to the ridge of the roof.

Figure 28B:
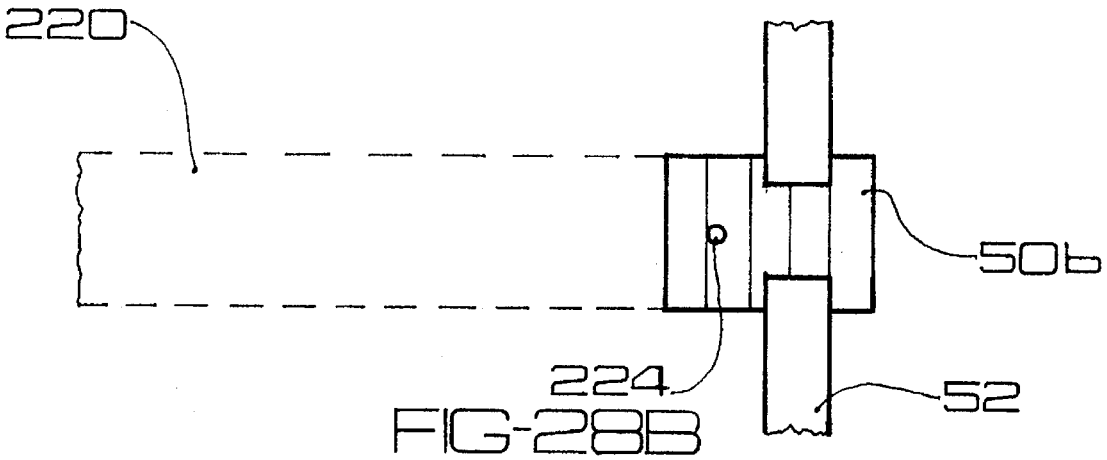
FIG. 28B is a sectional view taken along line 28B—28B of FIG. 28A.
Figure 28A:
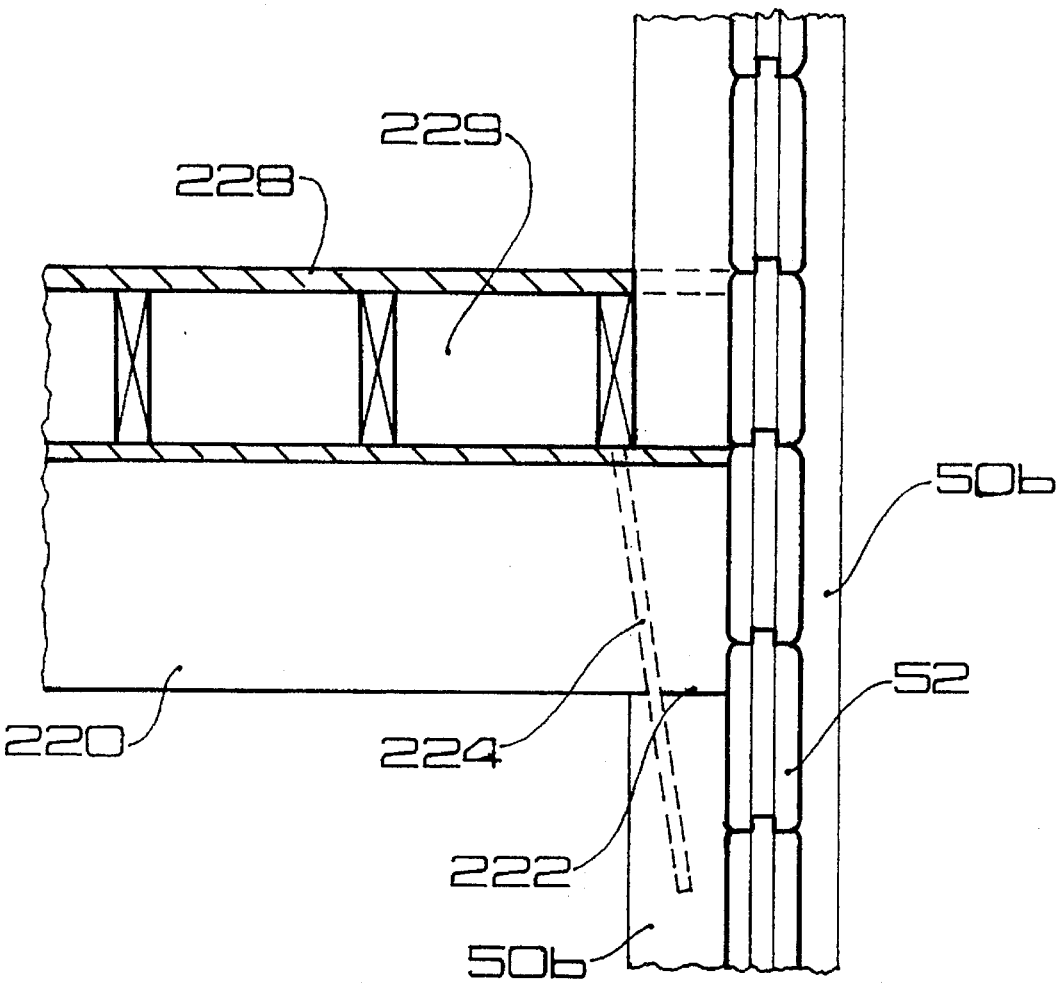
FIG. 28A is a vertical sectional view taken perpendicular to a wall section and illustrating a second floor construction while continuing the timber wall of the present invention upwardly to the second story of the building.

Reference is made to FIGS. 28A and 28B to illustrate the manner in which a second story can be built with the second story walls being of timber construction in accordance with the present invention. As shown in FIG. 28A, the column 50*b* is initially provided so that it extends upwardly beyond the second story level and to the top of the living area provided by the second floor to a roof supporting location. After the timbers 52 are erected up to the level of the second floor, the second floor beams 220 are put into place. A preferred method of accomplishing this is to notch out the interior portion of the column 50*a* (this being indicated at 222) to receive the end portion of the timber 220. To hold the timber in place, a steel pin 224 is driven through the beam 220 at a moderate slant to the vertical and into the upper inner portion of the column 50*a* just below the level of the beam 220.

Then the floor joists 226 are placed positioned across the beams 220, and the subfloor 228 installed to omplete the basic second floor structure 229. After this, the upper wall timbers 52 can continue to be put into place in the manner described previously herein.

Figure 29:
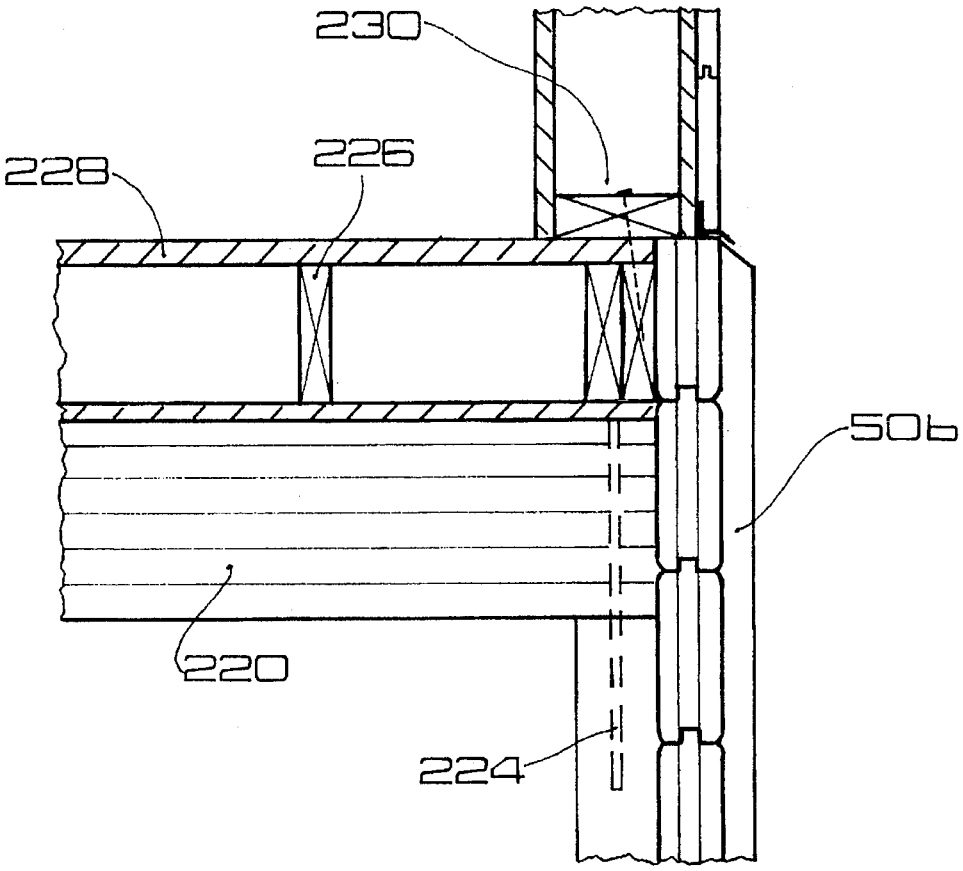
FIG. 29 is a sectional view similar to FIG. 28A, but showing the second floor structure being built where the timber wall of the present invention is terminated at the location of the second floor.

FIG. 29 illustrates the manner in which a second floor of a conventional frame construction can be constructed. In this instance, the first floor columns 50*b* are notched at the location of the lower surface of the second floor beam 220 and the columns 50 extend only to the second floor level. The upper timbers 52 are put into place, up to the level of the subfloor 228. Then the beams 228 are placed on top of the columns 50, and the floor joists 226 placed on the beams 220, and then the subfloor 220 is put into place. Also, a steel pin 224 is inserted through the end portion of the beam 220 and into the column 50.

After this is accomplished, the second floor of the house can be constructed in accordance with conventional construction practices. For example, the outside second story wall is shown at 230.

The roof of the house can be built in accordance with conventional building techniques. In some instances, it may be desired to design the home so that the timber construction in accordance with the present invention is provided all the way to the roof of the house. For example, in the front elevational view of FIG. 8, it can be seen that the timbers form the exterior wall all the way to the roof line.

Figure 30:
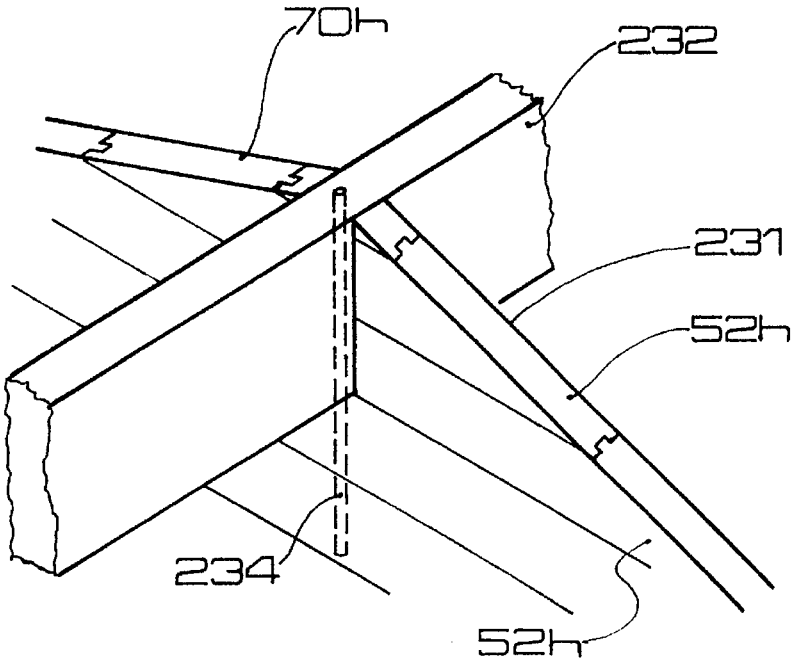
FIG. 30 is an isometric view illustrating the manner in which a roof beam is mounted to the timber wall of the present invention.

In this type of construction, those timbers 52 which are at the slanting roof line will be formed with a slanted surface 231 as illustrated at FIG. 30. Desirably, these timbers with slanted surfaces (indicated at 52*h* in FIG. 30) would be precut at the shop to form these slanted surfaces 230. These timbers 52*h* can be joined together in the manner described previously herein in Section "D" using the gluing techniques shown, and also inserting the self-tapping screws to join the timber 52*h* immediately above to the one below. In addition, longer screws or pins can also be utilized.

In FIG. 30, there is shown a ridge beam 232 extending from the upper wall portion 70*h* along the ridge of the roof. The timbers 52*h* at the location of the ridge beam 232 can be precut to accommodate the beam 232. Also, when the ridge beam 232 is in place, a pin 234 is inserted downwardly through the beam and into the adjoining timbers 52*h* below to provide reinforcement.

Figure 31:
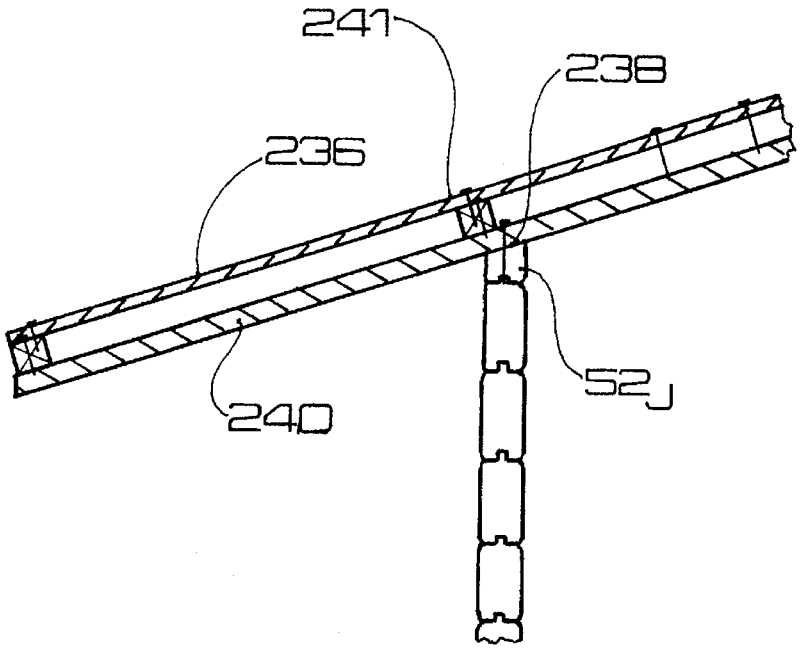
FIG. 31 is a vertical sectional view taken perpendicular to the wall section and illustrating a portion of the roof being mounted to the wall section.

FIG. 31 simply shows the manner in which a roof structure 236 can be mounted to the uppermost timber 52*j*. The upper surface 238 of the topmost timber 52*j* is slanted so that the lower surface 240 of the roof structure 241 can lie flushed against the surface 238.

H. Structural Aspects of the Present Invention

Figure 32:
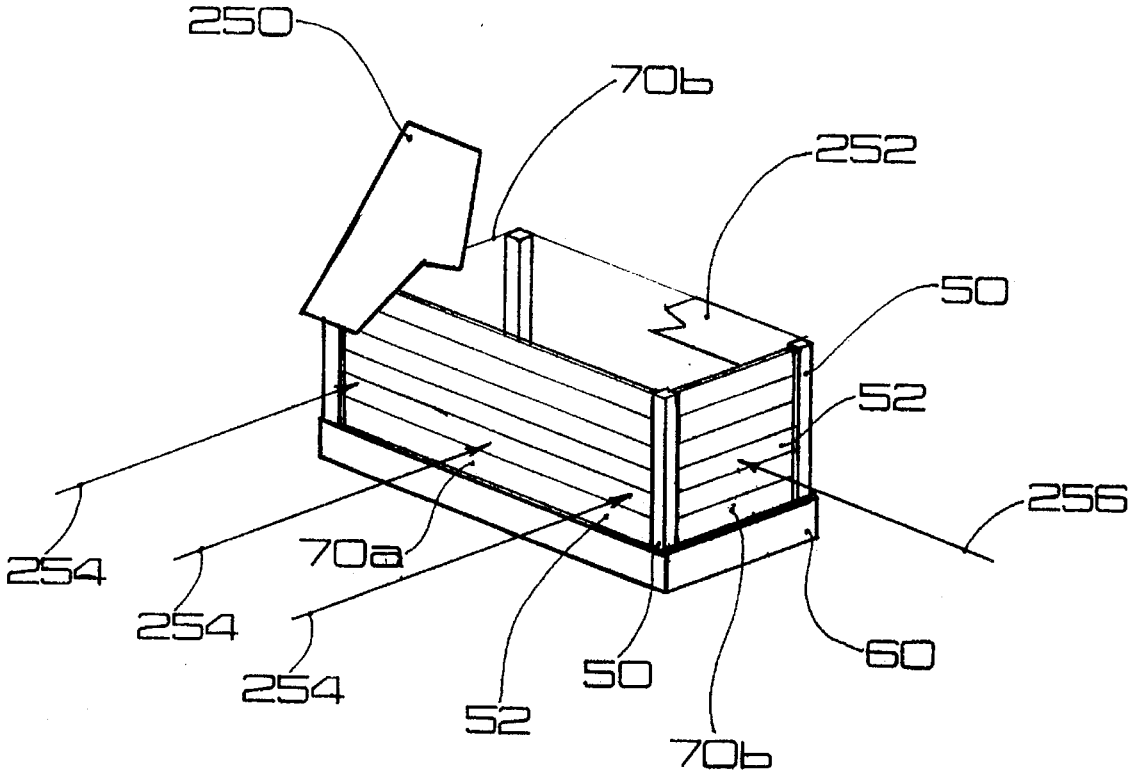
FIG. 32 is a simplified isometric view showing the basic structure of the present invention for purposes of explaining the manner in which loads are reacted into the structure.

With regard to the manner in which loads are reacted into the structure of the present invention, reference is made to FIG. 32, where there is a somewhat simplified (or schematic) view of the structure.

There is shown the base structure 60, the columns 50 and the timbers 52. The roof is indicated at 250, and there is shown a portion of the upper structure portion 252 which extends across the upper part of the home. The upper structure 252 can comprise part of the roof structure, and/or possibly the floor structure for a second story or loft. This upper structure 252 is characterized in that it interconnects with all of the columns 50 and forms a rigid upper diaphragm relative to the upper ends of the columns 50.

The base structure 60 in addition to providing vertical support, also provides a rigid structure firmly locating the bottom ends of the columns 50.

With regard to the manner in which loads are transmitted, vertical loads imposed on the home are largely transmitted into the columns 50 and into the base structure 60. However, vertical loads could also be supported at least in part by the timbers 52 in the walls 70.

With regard to laterally directed forces (e.g. either from the wind or possibly seismic forces), such as indicated at 254, these are transmitted into the side wall 70*a*. These would tend to cause the forward wall and rear wall 70*b* to "rack" (i.e. move from a rectangular configuration to a configuration of a parallelogram). This is resisted by the timbers 52 of the wall 70*b* being rigidly and firmly connected to one another not only by the adhesive bonding, by the mechanical interconnections, and also by the adhesive and mechanical connections to the beams 50.

These same lateral forces 254 would (with the wall sections 70 resisting distortion of the overall structure) tend to lift the building or a portion thereof off of its base structure 60, or even lift part of the base structure itself that is mounted to the foundation wall. This is resisted by the interconnection described above (particularly with respect to Section C, and in particular by the aforementioned straps 132 which are embedded in the concrete foundation and reach over the rim joist 118).

With regard to a diagonal force exerted in the direction indicated at line 256 of FIG. 32, this would tend to warp the upper part of the walls 70*a* and 70*b* out of rectangular configuration. The upper structure 252 (whether it be a part of the roof structure, loft or second floor structure) forms a rigid rectangular diaphragm which would resist this distortion. In addition, the tendency of this force 256 to move the walls 70*a* and 70*b* more toward a diamond shaped configuration is resisted by the rigid interconnection of the timbers 52.

This manner of transmitting loads differs from that of the conventional pre-cut timber construction, as described with reference to FIGS. 1–5. In the prior art precut timber home, the timbers 12 and 14 are interconnected at notched intersections. The wind loads (such as indicated at 256) are resisted in the prior art timber walls by the inter-engagement of the notches at the corners resisting relative lengthwise movement of the vertically aligned timbers 12 and 14 with respect to one another.

Also, in the prior art configuration of FIGS. 1–5, there are not the separate corner column 50*a* and side wall columns 50*b* to directly support much of the vertical loading.

With regard to the wind loads possibly lifting a portion or all of the building structure of the prior art of FIGS. 1 and 2, a common expedient has been to use tie down cables connected at the upper corner portions of the building to hold it to the foundation. In this respect the prior art also differs from the structure of the present invention.

With regard to the erection process, present analysis indicates that there is a significant savings in time in erecting the structure of the present invention in comparison with erecting a comparable structure constructed in accordance with the prior art (FIGS. 1 and 2).

Beyond this, for a given amount of floor space for the home, there is a material savings in the present invention in that it is not necessary to extend the timbers beyond the corner location. This is necessary in the prior art construction of FIGS. 1–5 so as to provide the notched portion which necessarily must be positioned inwardly from the end of the timber.

It is to be understood that various modifications could be made to the present invention without departing from the basic teachings thereof. Also, it is understood that the description contained in this text is arranged to show preferred designs, and when specific procedures, dimensions and arrangements are described these are not intended to limit the claims which define the scope of the present invention and follow this text.

We claim:

1. A method of providing pre-cut building components and assembling these components at a building site to erect a wood timber structure, said method comprising:

a. providing a building design that comprise a floor plan designating column locations and wall locations, said wall locations comprising at least first and second wall locations, each of which has first and second ends, the first ends of each of said first and second wall locations being adjacent to one another and angled at an acute wall angle relative to one another at a corner location, said design having a first column location at said corner location, and two second column locations at, respectively, the two second ends of the wall locations;

b. providing at said site a plurality of wood columns, each having in cross section at least one vertical slot of a predetermined width and depth extending along the length of that column, and some of said columns having at least two of said slots, said columns comprising at least one corner column member which has two vertical slots, each facing outwardly from the first column at an acute slot angle equal to said acute angle, and two second column members at said two second column locations, respectively;

c. providing at said site a plurality of wood wall timbers, each having side, upper, lower and end surfaces, each of said timbers having at least one end portion with a width dimension matching the width of a related slot of a related column so as to be able to fit within said related slot, and some of said timbers having two such end portions, each of said timbers having a predetermined lengthwise dimension, said timbers comprising first and second sets of timbers sized and configured to be placed at said first and second wall locations, respectively;

d. providing a base structure defining an upwardly facing base surface;

e. locating on said base structure said column locations, including said first and second column locations, and positioning each of said columns, including said first and second columns, vertically at related column locations and securing said columns to said base structure, with at least some of said columns comprising pairs of columns defining end location portions of a related wall location and with the columns of each pair having aligned slots facing each other at said end locations;

f. selecting sets of timbers sized and designated for each of said related wall locations, including said first and second sets of timbers, positioning each of said sets of timbers in said slots, and placing said timbers in said aligned slots one on top of the other to form wall sections of the timbers, comprising first and second wall sections made from said first and second sets of timbers;

g. securing each of said columns to said base structure;

h. securing the timbers of each set to said columns of said pair in a manner that portions of the timbers positioned within related slots are fixedly connected to their related columns to resist vertical and angular relative movement between the timbers in each set and the columns attached thereto; and i. securing said timbers to one another in a manner that relative movement of adjacent timbers in a direction parallel to the length of the timbers is resisted whereby lateral forces on said structure that are directed perpendicularly against said first wall section are transmitted at least partially into said first corner column, into said second wall section and into the second column of the second wall section, with angular movement of said corner column tending to move the timbers of the second wall section relative to one another along a line parallel to lengthwise axes of the timbers of the second wall section is resisted by:

i) connections between the corner column and the timber end portions adjacent thereto;

ii) connections between the timbers of the second wall section;

iii) connections between the second column of the second wall section and the end portions of the timbers connected thereto.

2. The method as recited in claim 1, further comprising connecting the timbers of a set to each other at least in part by applying an adhesive composition between adjacent surfaces of adjacent timbers of each wall section.

3. The method as recited in claim 2, further comprising connecting the end portions of the timbers to the columns by applying an adhesive composition between adjacent surfaces of the end portions of the timbers and surfaces defining the slots of the columns.

4. The method as recited in claim 3, comprising mechanically interconnecting end portions of the timbers to the columns in which the end portions are positioned.

5. The method as recited in claim 2, comprising mechanically interconnecting end portions of the timbers to the columns in which the end portions are positioned.

6. The method as recited in claim 1, further comprising providing a perimeter foundation wall and fixedly connecting rim joist means to the perimeter foundation wall along the length thereof, and fixedly connecting the columns to the rim joist means, said method being further characterized in that the room joist means is connected to the perimeter foundation wall by metal strap means engaging both of said foundation wall and said rim joist means, whereby loads tending to raise a portion of said structure vertically are resisted by said loads being transmitted from said structure into said columns, thence into said rim joist means and into said perimeter foundation wall.

7. The method as recited in claim 6, further comprising embedding lower ends of a plurality of metal straps of said metal strap means in said foundation wall which is a concrete foundation wall and securing upper edges of said metal straps to said rim joist means.

8. The method as recited in claim 7, further comprising providing reinforcing bar means in the concrete foundation wall, and attaching the lower ends of the metal straps to the reinforcing bar means.

9. The method as recited in claim 1, further comprising mechanically connecting adjacent upper and lower timbers to one another.

10. The method as recited in claim 1, wherein:

a. said base structure is providing by first putting a concrete foundation in place;

b. providing a plurality of restraining straps and embedding one end of each of said straps in said concrete foundation;

c. placing rim joist means on said foundation and placing second ends of said straps in retaining engagement with said rim joist means;

d. securing the columns to the base structure by mechanically attaching the columns to the rim joist means;

e. attaching end portions of the timbers to the columns by mechanically attaching end portions of the timbers to the columns to which they are securely connected.

11. The method as recited in claim 10, wherein a bottom timber of each set of timbers is mechanically attached to the rim joist means, and vertically adjacent timbers of each set are mechanically secured to one another.

12. The method as recited in claim 9, wherein said timbers are additionally connected to one another and also additionally connected to related columns by applying adhesive between adjacent timbers and also between end portions of said timbers and said columns.

13. The method as recited in claim 1, wherein:

a. said base structure is provided by first placing a foundation, then placing said rim joist on said foundation and fixedly connecting the rim joists to the foundation, and then placing at least a floor support structure and at least a subfloor;

b. identifying on the base structure the column locations;

c. positioning at least bottom timbers of each set at related wall locations and adjusting column locations as needed to properly match wall locations as indicated by placement of said bottom timbers.

14. The method as recited in claim 13, wherein at least column portions are positioned at the respective column locations and said bottom timbers are placed in positions relative to said at least column portions.

15. The method as recited in claim 1, further comprising providing at least one of said wall sections with a window opening which is positioned between the two columns engaging opposite end portions of the timbers of that wall section, said method further comprising providing vertically extending window perimeter members, at vertically aligned edge surfaces at said window opening, and interconnecting the perimeter members to the adjacent timbers to resist lateral relative movement of said adjacent timbers.

16. The method as recited in claim 1, further comprising providing a door opening in at least one of said wall sections said method comprising securing at least one right angle shaped reinforcing piece having two flange sections, with one flange section begin positioned vertically and connected to a vertically extending perimeter member that in turn connects to end portions of a plurality of adjacent timbers in said wall section, and the other flange being horizontally positioned and connecting to an upper timber above said doorway opening, whereby a mechanical tie is achieved between said upper timber and the timbers adjacent to the doorway opening to resist relative movement between adjacent timbers.

17. The method as recited in claim 1, further providing a slanting roof structure for said wood timber structure, said method comprises providing a plurality of horizontally extending vertically stacked timbers forming a roof support wall section, with loads from the roof structure being distributed downwardly through said roof support wall section to distribute roof loads through said roof support wall section to said base structure.

18. A structure made in accordance with the method recited in claim 1.

19. A building structure made from pre-cut wood building components assembled at a building site, said structure comprising:

a. a base structure having column locations and wall locations, said wall locations comprising at least first and second wall locations, each of which has first and second ends, the first ends of each of said first and second wall locations being adjacent to one another and angled at an acute wall angle relative to one another at a corner location, said base structure having a first column location at said corner location, and two second column locations at, respectively, the two second ends of the wall locations;

b. a plurality of wood columns, each having in cross section at least one vertical slot of a predetermined width and depth extending along the length of that column, and some of said columns having at least two of said slots, said columns comprising at least one corner column member which has two vertical slots, each facing outwardly from the first column at an acute slot angle equal to said acute angle, and two second column members at said two second column locations, respectively, said columns being vertically positioned at related column locations and secured to said base structure, with at least some of said columns comprising pairs of columns defining end location portions of related wall locations and with the columns of each of said pair having aligned slots facing each other at said end locations;

c. a plurality of wood wall timbers, each having side, upper, lower and end surfaces, each of said timbers having at least one end portion with a width dimension matching the width of a related slot of a related column so as to fit within said related slot, and some of said timbers having two such end portions, fitting within related slots of two related columns, each of said timbers having a predetermined lengthwise dimension, a plurality of groups of said timbers, being sized and designated each for a related wall location, the timbers of each group being positioned in said slots of their related pair of columns with the timbers in each group being stacked one on top of the other to form the related wall section of said structure, said timbers comprising first and second sets of timbers sized and configured to be placed at said first and second wall locations, respectively;

d. the timbers of each group being fixedly connected to the related columns and fixedly connected to one another at lengthwise locations along the length of each timber in a manner to resist vertical and angular relative movement between the timbers in each set and the columns attached thereto, and so that relative movement of adjacent timbers in a direction parallel to the length of the timbers is resisted, whereby lateral forces on said structure that are directed perpendicularly against said first wall section are transmitted at least partially into said first corner column, into said second wall section and into the second column of the second wall section, with angular movement of said corner column tending to move the timbers of the second wall section relative to one another along a line parallel to lengthwise axes of the timbers of the second wall section is resisted by:

i) connections between the corner column and the timber end portions adjacent thereto;

ii) connections between the timbers of the second wall section;

iii) connections between the second column of the second wall section and the end portions of the timbers connected thereto.

20. The structure as recited in claim 19, wherein each of said timbers in a wall section that is immediately adjacent to another timber immediately above has an adhesive composition along a substantial length of its upper surface so as to be bonded to the lower surface of the timber immediately above.

* * * * *